US009354576B1

(12) United States Patent
Nakamichi et al.

(10) Patent No.: US 9,354,576 B1
(45) Date of Patent: May 31, 2016

(54) IMAGE FORMING SYSTEM AND DISCHARGE METHOD OF RECORDING MATERIAL IN THE SAME

(71) Applicant: KONICA MINOLTA, INC., Chiyoda-ku, Tokyo (JP)

(72) Inventors: Motoki Nakamichi, Hachioji (JP); Hiroyuki Konishi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/944,079

(22) Filed: Nov. 17, 2015

(30) Foreign Application Priority Data

Dec. 24, 2014 (JP) ..... 2014-260960

(51) Int. Cl.
*G03G 15/00* (2006.01)
*G03G 21/14* (2006.01)
*B65H 7/06* (2006.01)

(52) U.S. Cl.
CPC ..... *G03G 15/55* (2013.01)

(58) Field of Classification Search
CPC ..... G03G 15/00; G03G 15/55; G03G 21/00; G03G 21/14; B65H 7/00; B65H 7/06
USPC ..... 399/9, 20, 21, 407
See application file for complete search history.

(56) References Cited

U.S. PATENT DOCUMENTS

2009/0110411 A1* 4/2009 Gungor ..... G03G 15/55 399/20
2010/0164171 A1* 7/2010 Feng ..... B65H 43/00 271/264
2014/0153937 A1* 6/2014 Unno ..... G03G 15/70 399/21
2014/0241737 A1* 8/2014 Shirasaka ..... G03G 15/6552 399/20

FOREIGN PATENT DOCUMENTS

JP 2010224305 A 10/2010

* cited by examiner

*Primary Examiner* — Nguyen Ha
(74) *Attorney, Agent, or Firm* — Holtz, Holtz & Volek PC

(57) ABSTRACT

Provided is an image forming system including a plurality of discharge units provided for discharging a recording material, an abnormality detection unit which detects conveyance abnormality of a recording material in a conveyance path in the image forming system, a position detection unit which detects a position of a user who performs a task of removing the recording material having caused the conveyance abnormality detected by the abnormality detection unit, a selection unit which selects a discharge unit, which is able to discharge a recording material remaining on a conveyance path of an upstream side and is nearest the position of the user detected by the position detection unit, from the plurality of discharge units, and a purge processing unit which allows the recording material remaining on the conveyance path of the upstream side from the discharge unit selected by the selection unit to be discharged from the discharge unit.

8 Claims, 12 Drawing Sheets

IMAGE FORMING SYSTEM AND DISCHARGE METHOD OF RECORDING MATERIAL IN THE SAME

CROSS-REFERENCE TO RELATED APPLICATION

This application is based on Japanese Patent Application No. 2014-260960 filed on Dec. 24, 2014, the contents of which are incorporated herein by reference.

BACKGROUND

1. Technical Field

The present invention relates to an image forming system and a discharge method of a recording material in the image forming system.

2. Description of Related Art

Conventionally, an image forming apparatus such as a printer, a copy machine, facsimile, and a multifunctional peripheral having all functions thereof has been widely used. There is a case in which a post-processing apparatus performing post-processing such as a stitching process and a folding process on a recording material (a paper and the like) with a formed image is connected to the image forming apparatus. Combinations of the image forming apparatus and the post-processing apparatus are changed in response to use purposes. Furthermore, there is also a case in which a plurality of post-processing apparatuses are connected to one image forming apparatus. Hereinafter, a system including an image forming apparatus and at least one post-processing apparatus will be referred to as an image forming system.

In recent years, when conveyance abnormality such as jam occurs in a post-processing apparatus, an image forming system temporarily withdraws a recording material being conveyed in an image forming apparatus and the like to a predetermined position, and automatically discharges the withdrawn recording material after a recording material having caused the conveyance abnormality is removed. A technology (a function) of discharging the recording material as described above is called a purge process (called "automatic purge" or simply "purge") as disclosed in Japanese Patent Application Laid-Open Publication No. 2010-224305. The purge process is performed, so that a task of a user for removing a recording material remaining in the image forming system is reduced.

In general specifications of the purge process, a recording material having caused conveyance abnormality is removed, and then the purge process is automatically started. Therefore, it is necessary to register a discharge destination (indicating a paper discharge tray and hereinafter, also referred to as a "discharge unit") of the recording material in advance.

However, all users do not know a discharge destination of a recording material at the time of the purge process. Therefore, although the purge process has been performed, a user may not recognize that the recording material has been discharged and may forget it.

Furthermore, even when a user can specify the discharge destination of the recording material, if a plurality of post-processing apparatuses have been connected, the discharge destination may also be remote from the position of the user who is performing a task of removing the recording material. In this case, since the user needs to go for the recording material up to the discharge destination, it becomes a troublesome task.

SUMMARY

The present invention is achieved in view of the problems described above. Therefore, an object of the present invention is to provide an image forming system and the like capable of preventing forgetting of a recording material to be discharged at the time of a purge process and simplifying a task of going for the recording material up to a discharge destination (a discharge unit).

To achieve at least one of the abovementioned objects, an image forming system reflecting one aspect of the present invention is an image forming system including an image forming apparatus that forms an image on a recording material and one or more post-processing apparatuses that perform post-processing on the recording material with the formed image, and includes: a plurality of discharge units provided in the image forming system in order to discharge a recording material; an abnormality detection unit which detects conveyance abnormality of a recording material in a conveyance path in the image forming system; a position detection unit which detects a position of a user who performs a task of removing the recording material having caused the conveyance abnormality detected by the abnormality detection unit; a selection unit which selects a discharge unit, which is able to discharge a recording material remaining on a conveyance path of an upstream side and is nearest the position of the user detected by the position detection unit, from the plurality of discharge units; and a purge processing unit which allows the recording material remaining on the conveyance path of the upstream side from the discharge unit selected by the selection unit to be discharged from the discharge unit.

In a case in which a plurality of post-processing apparatuses are provided, preferably, after conveyance abnormality of a recording material is detected in two or more post-processing apparatuses by the abnormality detection unit, when a task of removing the recording material has ended in all the post-processing apparatuses, if a discharge unit provided in a post-processing apparatus in which the removal task has been finally performed is able to discharge the recording material remaining on the conveyance path, the selection unit selects the discharge unit.

In a case in which a plurality of post-processing apparatuses are provided, preferably, after conveyance abnormality of a recording material is detected in two or more post-processing apparatuses by the abnormality detection unit, when a task of removing the recording materials has ended in at least one post-processing apparatus, if a discharge unit provided in the post-processing apparatus is able to discharge the recording material remaining on the conveyance path, the selection unit selects the discharge unit.

In a case in which a plurality of post-processing apparatuses are provided, preferably, after conveyance abnormality of a recording material is detected in two or more post-processing apparatuses by the abnormality detection unit, when a task of removing the recording materials has been started in at least one post-processing apparatus, if a discharge unit provided in a post-processing apparatus approximate to an upstream side of the post-processing apparatus is able to discharge the recording material remaining on the conveyance path, the selection unit selects the discharge unit.

Preferably, the image forming system further includes an order notification unit which notifies a user of an order of post-processing apparatuses to perform the task of removing the recording materials in a case in which the conveyance abnormality of the recording material has been detected in two or more post-processing apparatuses by the abnormality detection unit.

Preferably, the image forming system further includes a procedure notification unit which notifies a user of a procedure of a task of removing a recording material when there is a post-processing apparatus in which a recording material has not been removed even after discharge of a recording material by the purge processing unit is started.

Preferably, the image forming system further includes a situation notification unit which notifies a user of a discharge situation of a recording material while discharge of the recording material by the purge processing unit is being performed, and, when the discharge of the recording material by the purge processing unit has been completed, notifies the user that the discharge of the recording material has been completed.

The objects, features, and characteristics of this invention other than those set forth above will become apparent from the description given herein below with reference to preferred embodiments illustrated in the accompanying drawings.

DETAILED DESCRIPTION

Figure 1:
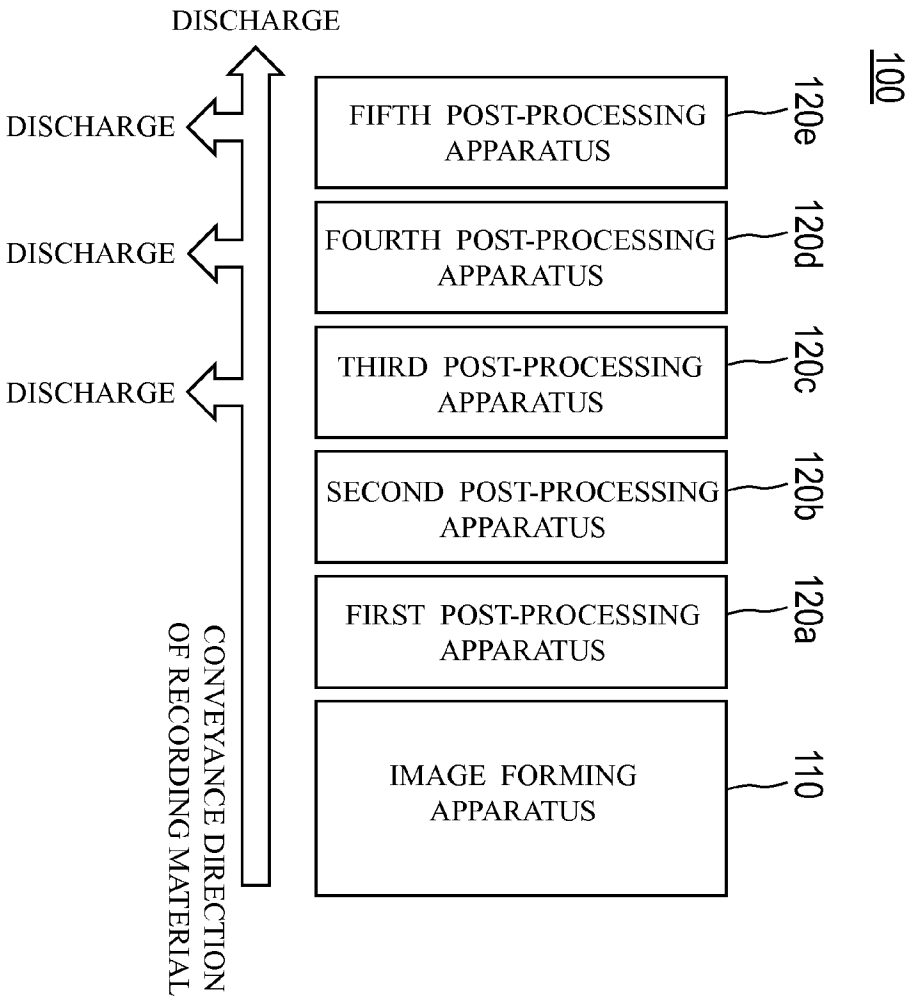
FIG. 1 is a diagram illustrating a schematic configuration example of an image forming system according to a first embodiment.

Hereinafter, embodiments of the present invention will be described with reference to the accompanying drawings. In the description of the drawings, the same elements are denoted by the same reference numerals, and redundant description is omitted. In addition, in some cases, dimensional ratios in the drawings are exaggerated and different from actual ratios for convenience of the description.

First Embodiment

Figure 2:
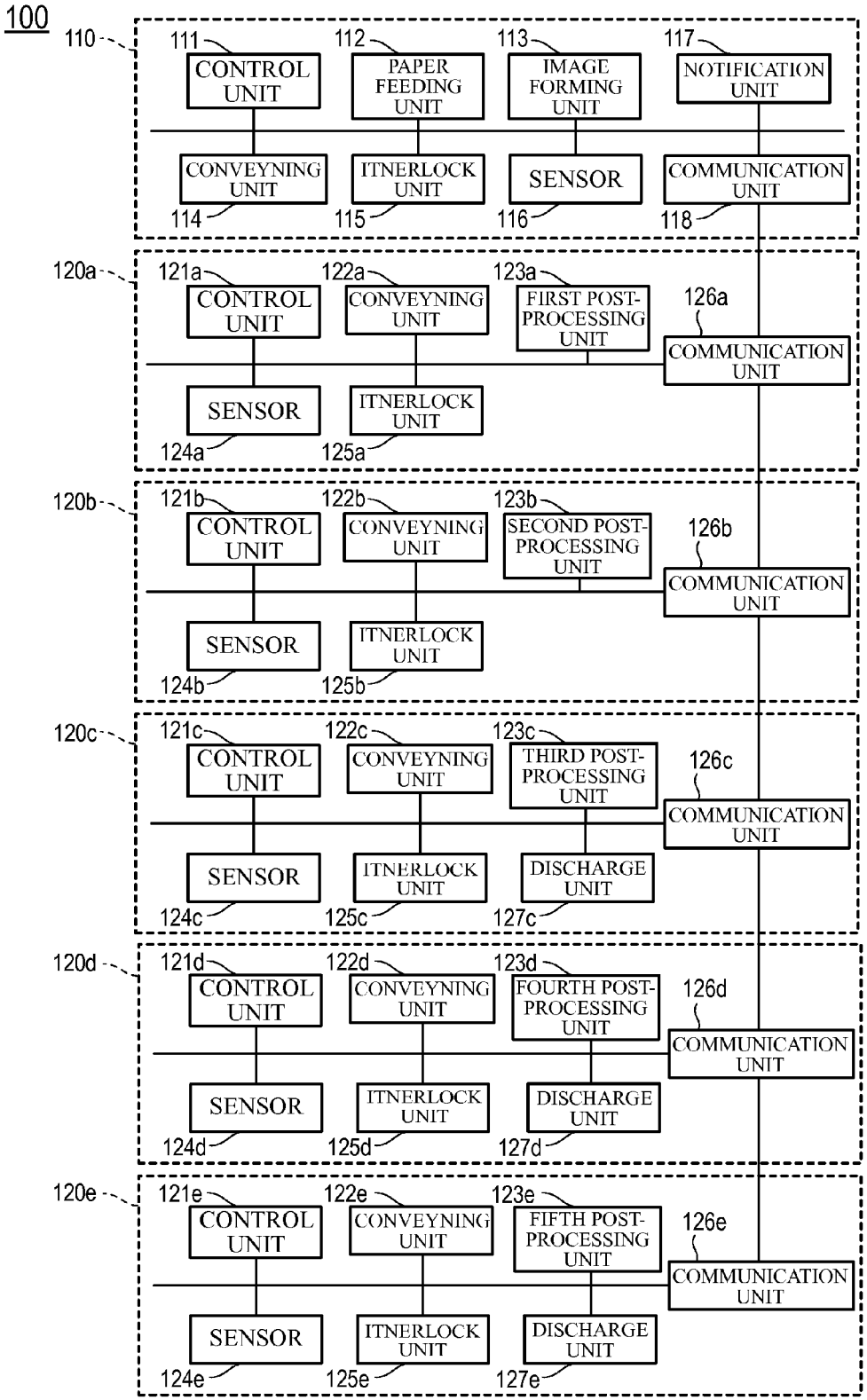
FIG. 2 is a block diagram illustrating a hardware configuration example of an image forming system according to a first embodiment.

FIG. 1 is a diagram illustrating a schematic configuration example of an image forming system according to a first embodiment. FIG. 2 is a block diagram illustrating a hardware configuration example of the image forming system according to the first embodiment. Hereinafter, with referenced to FIG. 1 and FIG. 2, a schematic configuration of an image forming system 100, particularly, a hardware configuration will be described.

<Image Forming System 100 (Hardware Configuration)>

(1) Entire Configuration

As illustrated in FIG. 1 and FIG. 2, the image forming system 100 includes an image forming apparatus 110 and a plurality of post-processing apparatuses 120*a* to 120*e*. For example, from an upstream side along a conveyance direction of a recording material such as a paper, the image forming apparatus 110, the first post-processing apparatus 120*a*, the second post-processing apparatus 120*b*, the third post-processing apparatus 120*c*, the fourth post-processing apparatus 120*d*, and the fifth post-processing apparatus 120*e* are continuously connected (in the illustrated order).

The image forming apparatus 110 has at least a print function and forms an image on a recording material. In addition, the image forming apparatus 110 may also have a copy function, a scan function, a facsimile function and the like.

In the present embodiment, the first post-processing apparatus 120*a* and the second post-processing apparatus 120*b* are post-processing apparatuses which do not have a discharge function (a discharge unit) of a recording material. The first post-processing apparatus 120*a* and the second post-processing apparatus 120*b* respectively perform specific post-processing on a recording material conveyed from an upstream apparatus. For example, the first post-processing apparatus 120*a* is a humidifying apparatus that supplies moisture to a recording material conveyed from the image forming apparatus 110. The moisture is supplied, so that bending, waving, waviness and the like of the recording material are removed. Furthermore, the second post-processing apparatus 120*b* is an inversion conveying apparatus that inverts the front and the back of the recording material conveyed from the first post-processing apparatus 120*a*. However, the first post-processing apparatus 120*a* and the second post-processing apparatus 120*b* are not limited thereto, and may be post-processing apparatuses having (or performing) other functions.

In the present embodiment, the third post-processing apparatus 120*c*, the fourth post-processing apparatus 120*d*, and the fifth post-processing apparatus 120*e* are post-processing apparatuses which have a discharge function (a discharge unit) of a recording material. The third post-processing apparatus 120*c*, the fourth post-processing apparatus 120*d*, and the fifth post-processing apparatus 120*e* respectively perform specific post-processing on a recording material conveyed from an upstream apparatus. For example, the third post-processing apparatus 120*c* is a punching apparatus that opens a punch hole in a recording material conveyed from the second post-processing apparatus 120*b*. Furthermore, the fourth post-processing apparatus 120*d* is a folding apparatus for making a crease in a recording material conveyed from the third post-processing apparatus 120*c*. Furthermore, the fifth post-processing apparatus 120*e* is a stapler for performing a stitching process by driving a staple to a recording material conveyed from the fourth post-processing apparatus 120*d*. However, the third post-processing apparatus 120*c*, the fourth post-processing apparatus 120*d*, and the fifth post-processing apparatus 120*e* are not limited thereto, and may be post-processing apparatuses having (or performing) other functions. The third post-processing apparatus 120*c*, the fourth post-processing apparatus 120*d*, and the fifth post-processing apparatus 120*e* discharge the corresponding recording materials to designated discharge destinations (discharge units). Hereinafter, each apparatus will be described.

(2) Image Forming Apparatus 110 (Hardware Configuration)

Firstly, the hardware configuration of the image forming apparatus 110 will be described.

As illustrated in FIG. 2, the image forming apparatus 110 has a control unit 111, a paper feeding unit 112, an image forming unit 113, a conveying unit 114, an interlock unit 115, a sensor 116, a notification unit 117, and a communication unit 118. The respective units 111 to 118 are connected to one another via a signal line (a bus and the like) for exchanging signals.

(2-1) Control Unit 111

The control unit 111 controls the entire image forming apparatus 110. For example, the control unit 111 has CPU (Central Processing Unit), a memory, and a storage (not illustrated).

The CPU is a control circuit configured from a multicore processor and the like that perform the control of the above-described respective units 112 to 118 and various calculation processes according to programs, and each function of the image forming apparatus 110 is exhibited when the CPU executes the programs corresponding to the functions.

The memory is a high-speed accessible main storage device as a working area which temporarily stores programs and data. The memory, for example, employs DRAM (Dynamic Random Access Memory), SDRAM (Synchronous Dynamic Random Access Memory), SRAM (Static Random Access Memory) and the like.

The storage is an auxiliary storage device with high capacity which stores various programs including an operating system and various types of data. The storage, for example, employs a hard disk, a solid state drive, a flash memory, ROM and the like.

(2-2) Paper Feeding Unit 112

The paper feeding unit 112 feeds a recording material toward the image forming unit 113. For example, the paper feeding unit 112 employs a scheme for allowing a paper feeding roller to make contact with the uppermost recording material loaded on a paper feeding tray and sending out the recording material by friction force thereof. Furthermore, the paper feeding unit 112 (including the paper feeding tray) needs not to be provided in a housing of the image forming apparatus 110, and may also be installed as an external paper feeding device independent of the image forming apparatus 110.

(2-3) Image Forming Unit 113

The image forming unit 113 forms an image based on various types of data on a recording material by using a well-known image creating process such as an electrophotographic process including charging, exposure, development, transfer, and fixing processes.

For example, the image forming unit 113 uses a photosensitive drum as an image carrying member (may also use an intermediate transfer belt). On the photosensitive drum, a toner image of each color (Y, M, C, and K) is formed by a charging roller, a developing roller and the like, and bias having a polarity opposite to that of toner is applied to a transfer roller, so that the toner image on the photosensitive drum is transferred onto a recording material.

Furthermore, the recording material with the formed toner image is separated from the surface of the photosensitive drum and is conveyed to a heating fixing device. The heating fixing device fixes the toner image formed on the recording material as an eternal image by heating, pressing and the like.

(2-4) Conveying Unit 114

The conveying unit 114 conveys a recording material along a conveyance path in the image forming apparatus 110. For example, the conveying unit 114 rotates a pair of conveying rollers by driving a conveying motor, thereby conveying a recording material toward the image forming unit 113 from the paper feeding unit 112 or conveying a recording material having passed through the image forming unit 113 to the first post-processing apparatus 120*a*. Furthermore, at the time of duplex printing, the conveying unit 114 inverts the front and the back of the recording material having passed through the image forming unit 113 and conveys the recording material to the image forming unit 113 again.

(2-5) Interlock Unit 115

The interlock unit 115 is a safety device for stopping the conveyance of a recording material when a front door for protecting an internal mechanism of the image forming apparatus 110 has been opened. The interlock unit 115 detects the opening and closing of the front door and notifies the control unit 111 of the detection result.

(2-6) Sensor 116

The sensor 116, for example, is a plurality of optical sensors provided at the necessary points of a conveyance path. Each sensor 116 detects the presence and the like of a recording material on the conveyance path at the installed point, and notifies the control unit 111 of the detection result.

(2-7) Notification Unit 117

The notification unit 117 notifies a user of a predetermined message. For example, the notification unit 117 is configured by a display and a speaker, and notifies a user of an operating method of the image forming system 100, a coping method of troubles generated in the image forming system 100, and the like.

(2-8) Communication Unit 118

The communication unit 118 is an interface for communicating with other apparatuses. The communication unit 118 performs transmission and reception of various setting values, various types of information necessary for operation timing control, the detection result by the sensor 116, information indicating the occurrence of conveyance abnormality (jam and the like) of a recording material, and the like with respect to the first to fifth post-processing apparatuses 120*a* to 120*e*.

(3) First and Second Post-Processing Apparatuses 120*a* and 120*b* (Hardware Configuration)

Next, the hardware configurations of the first and second post-processing apparatuses 120*a* and 120*b* will be described.

As illustrated in FIG. 2, the first and second post-processing apparatuses 120*a* and 120*b* have control units 121*a* and 121*b*, conveying units 122*a* and 122*b*, first and second post-processing units 123*a* and 123*b*, sensors 124*a* and 124*b*, interlock units 125*a* and 125*b*, and communication units 126*a* and 126*b*, respectively. The parts 121*a* to 126*a* and 121*b* to 126*b* are respectively connected to one another via signal lines (buses and the like) for exchanging signals.

(3-1) Control Units 121*a* and 121*b*

The control unit 121*a* controls the whole of the first post-processing apparatus 120*a*. Furthermore, the control unit 121*b* controls the whole of the second post-processing apparatus 120*b*. For example, each of the control units 121*a* and

121*b* has CPU, a memory, and a storage (not illustrated) similarly to the control unit 111 of the image forming apparatus 110.

(3-2) Conveying Units 122*a* and 122*b*

The conveying unit 122*a* conveys a recording material along a conveyance path in the first post-processing apparatus 120*a*. For example, the conveying unit 122*a* rotates a pair of conveying rollers by the driving of a conveying motor, thereby conveying a recording material conveyed from the image forming apparatus 110 toward the first post-processing unit 123*a* or conveying a recording material having passed through the first post-processing unit 123*a* to the second post-processing apparatus 120*b*. In a similar manner, the conveying unit 122*b* conveys a recording material conveyed from the first post-processing apparatus 120*a* toward the second post-processing unit 123*b* or conveys a recording material having passed through the second post-processing unit 123*b* to the third post-processing apparatus 120*c*.

(3-3) First and Second Post-Processing Units 123*a* and 123*b*

The first post-processing unit 123*a* conveys a recording material while interposing the recording material between a pair of humidifying rollers. Since moisture is supplied to the surfaces of the humidifying rollers, the entire surface of the recording material passing therethrough is uniformly humidified. Furthermore, the second post-processing unit 123*b* is configured by a switchback path formed in the approximately vertical (gravity) direction. The recording material is fed to the switchback path and is reversely conveyed, so that the front and the back of the recording material can be inverted.

(3-4) Sensors 124*a* and 124*b*

Each of the sensors 124*a* and 124*b* is a plurality of optical sensors provided at the necessary points of a conveyance path, similarly to the sensor 116 of the image forming apparatus 110.

(3-5) Interlock Units 125*a* and 125*b*

Each of the interlock units 125*a* and 125*b* is a safety device for stopping the conveyance of a recording material when a front door for protecting an internal mechanism has been opened. The interlock units 125*a* and 125*b* detect the opening and closing of the front doors and notify the image forming apparatus 110 of the detection result.

(3-6) Communication Units 126*a* and 126*b*

Each of the communication units 126*a* and 126*b* is an interface for communicating with other apparatuses, similarly to the communication unit 118 of the image forming apparatus 110.

(4) Third to Fifth Post-Processing Apparatuses 120*c* to 120*e* (Hardware Configuration)

Next, the hardware configurations of the third to fifth post-processing apparatuses 120*c* to 120*e* will be described.

As illustrated in FIG. 2, the third to fifth post-processing apparatuses 120*c* to 120*e* have control units 121*c* to 121*e*, conveying units 122*c* to 122*e*, third to fifth post-processing units 123*c* to 123*e*, sensors 124*c* to 124*e*, interlock units 125*c* to 125*e*, communication units 126*c* to 126*e*, and discharge units 127*c* to 127*e*, respectively. The parts 121*c* to 127*c*, 121*d* to 127*d*, and 121*e* to 127*e* are respectively connected to one another via signal lines (buses and the like) for exchanging signals.

(4-1) Control Units 121*c* to 121*e*

The control unit 121*c* controls the whole of the third post-processing apparatus 120*c*. Furthermore, the control unit 121*d* controls the whole of the fourth post-processing apparatus 120*d*. Furthermore, the control unit 121*e* controls the whole of the fifth post-processing apparatus 120*e*. For example, each of the control units 121*c* to 121*e* has CPU, a memory, and a storage (not illustrated) similarly to the control unit 111 of the image forming apparatus 110.

(4-2) Conveying Units 122*c* to 122*e*

The conveying unit 122*c* conveys a recording material along a conveyance path in the third post-processing apparatus 120*c*. For example, the conveying unit 122*c* rotates a pair of conveying rollers by the driving of a conveying motor, thereby conveying a recording material conveyed from the second post-processing apparatus 120*b* toward the third post-processing unit 123*c* or conveying a recording material having passed through the third post-processing unit 123*c* to the fourth post-processing apparatus 120*d* or the discharge unit 127*c*. In a similar manner, the conveying unit 122*d* conveys a recording material conveyed from the third post-processing apparatus 120*c* toward the fourth post-processing unit 123*d* or conveys a recording material having passed through the fourth post-processing unit 123*d* to the fifth post-processing apparatus 120*e* or the discharge unit 127*d*. In a similar manner, the conveying unit 122*e* conveys a recording material conveyed from the fourth post-processing apparatus 120*d* toward the fifth post-processing unit 123*e* or conveys a recording material having passed through the fifth post-processing unit 123*e* to the discharge unit 127*e*.

(4-3) Third to Fifth Second Post-Processing Units 123*c* to 123*e*

The third post-processing unit 123*c* has a general mechanism for opening a punch hole in a recording material. Furthermore, the fourth post-processing unit 123*d* has a general mechanism for making a crease in a recording material. Furthermore, the fifth post-processing unit 123*e* has a general mechanism for performing a stitching process by driving staples to a recording material.

(4-4) Sensors 124*c* to 124*e*

Each of the sensors 124*c* to 124*e* is a plurality of optical sensors provided at the necessary points of a conveyance path, similarly to the sensor 116 of the image forming apparatus 110.

(4-5) Interlock Units 125*c* to 125*e*

Each of the interlock units 125*c* to 125*e* is a safety device for stopping the conveyance of a recording material when a front door for protecting an internal mechanism has been opened. The interlock units 125*c* to 125*e* detect the opening and closing of the front doors and notify the image forming apparatus 110 of the detection result.

(4-6) Communication Units 126*c* to 126*e*

Each of the communication units 126*c* to 126*e* is an interface for communicating with other apparatuses, similarly to the communication unit 118 of the image forming apparatus 110.

(4-7) Discharge Units 127*c* to 127*e*

The image forming system 100 is provided with the plurality of discharge units 127*c* to 127*e* for discharging recording materials.

The discharge unit 127*c* is provided in the third post-processing apparatus 120*c* and discharges a recording material conveyed from an upstream side to the outside of the third post-processing apparatus 120*c*. In a similar manner, the discharge unit 127*d* is provided in the fourth post-processing apparatus 120*d* and discharges a recording material conveyed from an upstream side to the outside of the fourth post-processing apparatus 120*d*. In a similar manner, the discharge unit 127*e* is provided in the fifth post-processing apparatus 120*e* and discharges a recording material conveyed from an upstream side to the outside of the fifth post-processing apparatus 120*e*. For example, each of the discharge units 127*c* to 127*e* rotates a pair of paper discharging rollers by the driving of a paper discharging motor, thereby discharging a recording material to a paper discharging tray.

<Image Forming Apparatus 110 (Functional Configuration)>

The image forming apparatus 110 included in the image forming system 100 having the hardware configuration as described above has the following functional configuration.

Figure 3:
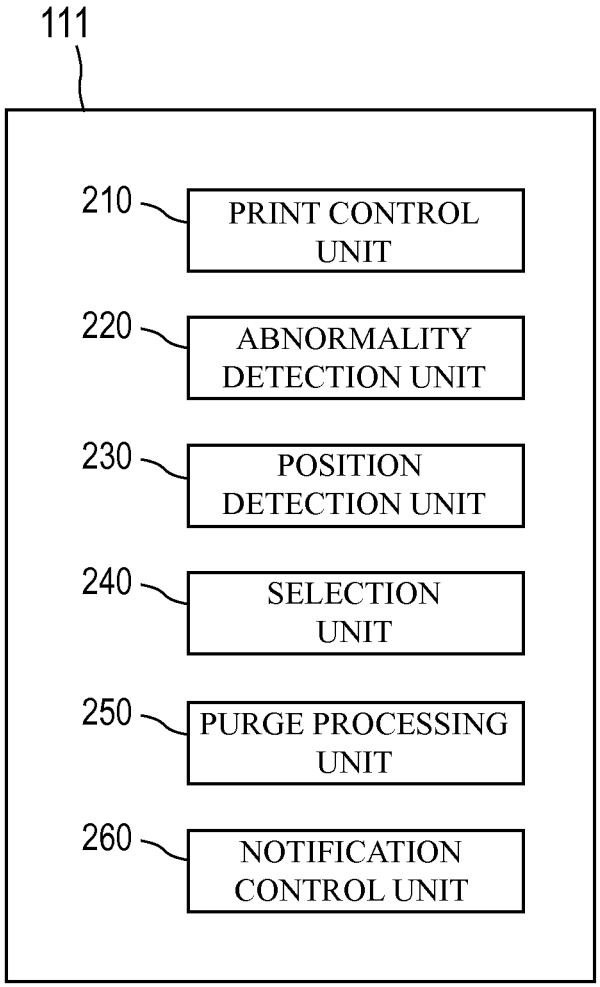
FIG. 3 is a block diagram illustrating a functional configuration example of an image forming apparatus according to a first embodiment.

FIG. 3 is a block diagram illustrating a functional configuration example of the image forming apparatus 110 according to the first embodiment.

As illustrated in FIG. 3, the control unit 111 of the image forming apparatus 110 has a print control unit 210, an abnormality detection unit 220, a position detection unit 230, a selection unit 240, a purge processing unit 250, and a notification control unit 260.

(1) Print Control Unit 210

The print control unit 210 controls the paper feeding unit 112, the image forming unit 113, and the conveying unit 114 and performs a print process. For example, the print control unit 210 allows an image based on print data included in a print job received by the image forming apparatus 110 to be formed on a recording material. Then, the print control unit 210 allows the recording material with the formed image to pass through the first to fifth post-processing apparatuses 120*a* to 120*e* and the like and to be discharged from any one of the discharge units 127*c* to 127*e*.

(2) Abnormality Detection Unit 220

The abnormality detection unit 220 detects the occurrence and release of conveyance abnormality such as jam in the conveyance path in the image forming system 100 on the basis of the notification of the sensor 116 of the image forming apparatus 110, the sensors 124*a* to 124*e* of the first to fifth post-processing apparatuses 120*a* to 120*e*, and the like. For example, when it has been detected that a recording material stops at the same position for a long time (equal to or more than a predetermined threshold value) on the basis of signals (a paper presence signal and the like) from the sensor 116, the sensors 124*a* to 124*e*, the abnormality detection unit 220 determines that conveyance abnormality has occurred. On the other hand, when it has been detected that a recording material having caused conveyance abnormality does not exist on the basis of a signal (a paper absence signal and the like) from a sensor having detected the conveyance abnormality, the abnormality detection unit 220 determines that the conveyance abnormality has been released.

(3) Position Detection Unit 230

The position detection unit 230 detects the position of a user who performs a task of removing the recording material having caused the conveyance abnormality detected by the abnormality detection unit 220. For example, when the opening and closing of the front door have been notified from at least the interlock units 115 and 125*a* to 125*e*, the position detection unit 230 detects the position of a post-processing apparatus having made the notification as the position of the user who performs the task of removing the recording material.

(4) Selection Unit 240

The selection unit 240 selects (decides) the discharge destination of a recording material at the time of a purge process from the plurality of discharge units 127*c* to 127*e*. In detail, the selection unit 240 selects a discharge unit which can discharge a recording material remaining on a conveyance path of an upstream side and is nearest the position of the user detected by the position detection unit 230. For example, in the case in which the conveyance abnormality of recording materials has been detected in two or more post-processing apparatuses by the abnormality detection unit 220, when a task of removing the recording materials has ended in all the post-processing apparatuses, the selection unit 240 selects a discharge unit provided in a post-processing apparatus in which the removal task has been finally performed. However, it is limited to the case in which a recording material remaining on a conveyance path of an upstream side of the discharge unit can be discharged from the discharge unit.

In addition, the state in which a recording material can be discharged in a discharge unit represents the state (a ready state) in which conveyance abnormality and the like do not occur in a conveyance path of an upstream side of the discharge unit and an initial operation has been completed in each apparatus of the upstream side of the discharge unit.

(5) Purge Processing Unit 250

The purge processing unit 250 allows a recording material remaining on a conveyance path of an upstream side of the discharge unit selected by the selection unit 240 to be discharged from the discharge unit. For example, the purge processing unit 250 controls the conveying units 114 and 122*a* to 122*e* in the image forming system 100, thereby allowing the recording material remaining on the conveyance path to be discharged.

(6) Notification Control Unit 260

The notification control unit 260 controls the notification unit 117, thereby notifying a user of a predetermined message. For example, the notification control unit 260 allows the notification unit 117 to notify an operating method of the image forming system. 100, a coping method of troubles generated in the image forming system 100, and the like.

In addition, the functional units 210 to 260 are respectively implemented when the CPU reads the programs installed in the storage to the memory and executes the programs in the image forming apparatus 110. However, the present invention is not limited thereto, and the functional units 210 to 260 may also be implemented by hardware such as ASIC.

Furthermore, the functional configuration of each of the post-processing apparatuses 120*a* to 120*e* is not described, but each of the post-processing apparatuses 120*a* to 120*e* has functional units necessary for achieving the present invention, similarly to the functional units of the image forming apparatus 110. The functional units of each of the post-processing apparatuses 120*a* to 120*e* are also implemented when the CPU of each of the post-processing apparatuses 120*a* to 120*e* reads the programs installed in the storage to the memory and executes the programs.

<Operation of Image Forming System 100>

Next, the characteristic operation of the image forming system 100 according to the first embodiment will be described.

(1) Print Process (First Embodiment)

Figure 4:
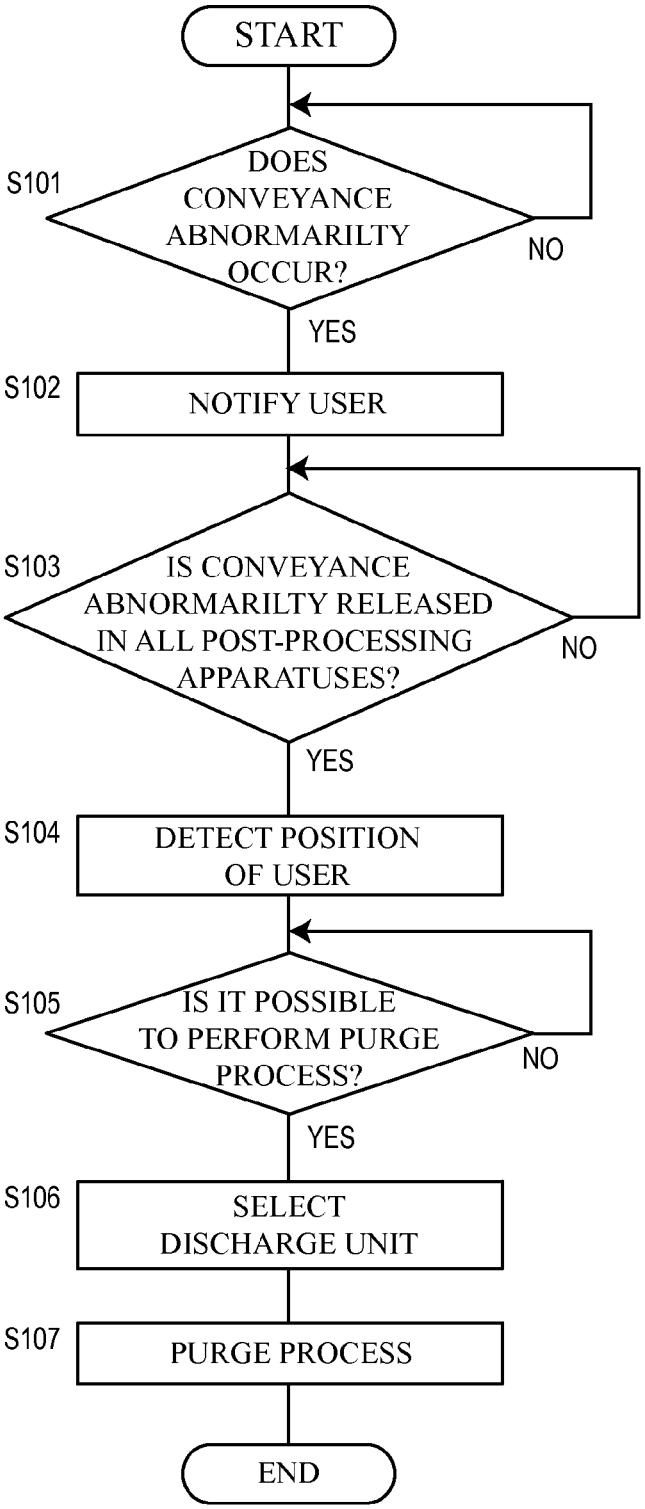
FIG. 4 is a flowchart illustrating the procedure of a print process according to a first embodiment.
Figure 5:
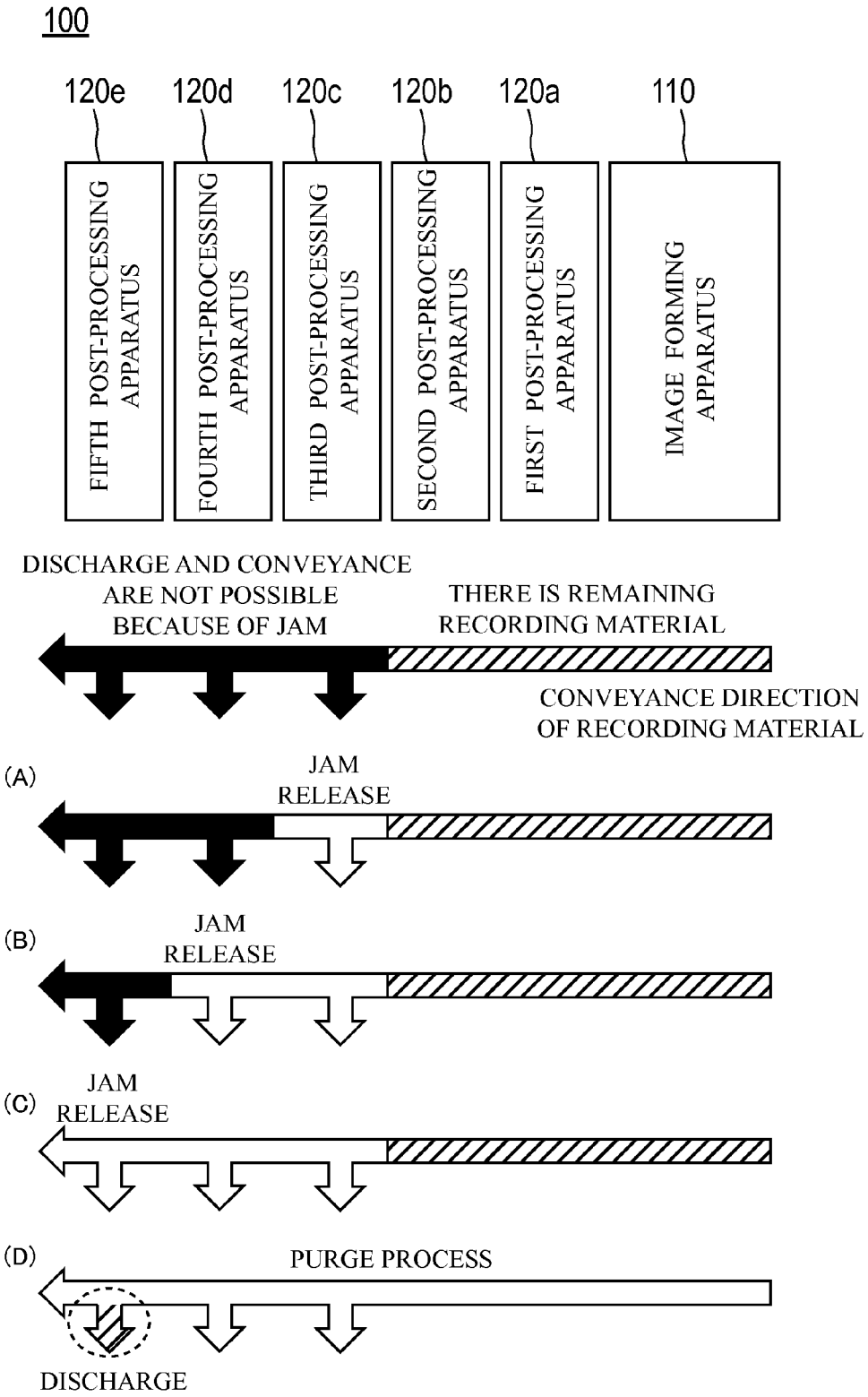
FIG. 5 is a diagram illustrating an operation example 1 until a purge process is performed after conveyance abnormality occurs in an image forming system according to a first embodiment.
Figure 6:
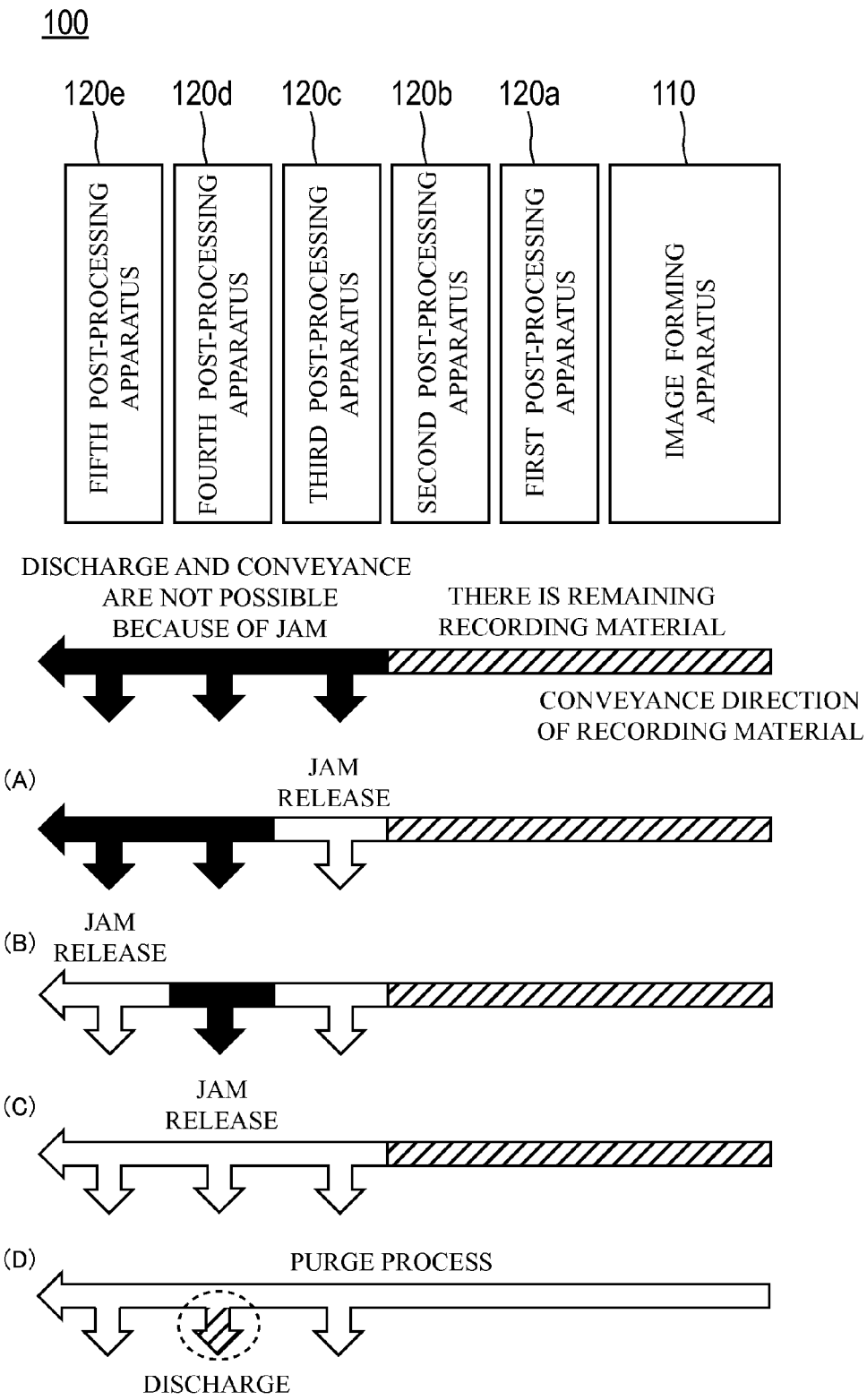
FIG. 6 is a diagram illustrating an operation example 2 until a purge process is performed after conveyance abnormality occurs in an image forming system according to a first embodiment.

FIG. 4 is a flowchart illustrating the procedure of the print process according to the first embodiment. FIG. 5 is a diagram illustrating an operation example 1 until the purge process is performed after conveyance abnormality occurs in the image forming system according to the first embodiment. FIG. 6 is a diagram illustrating an operation example 2 until the purge process is performed after the conveyance abnormality occurs in the image forming system according to the first embodiment.

Hereinafter, with reference to FIG. 4 to FIG. 6, the print process according to the first embodiment will be described.

The image forming apparatus 110 starts the print process illustrated in FIG. 4 at a timing at which a print instruction has been received from a user. However, the timing at which the print process starts is not limited thereto, and the print process may also start when a copy instruction has been received from a user. Furthermore, the print process may also start when print data or facsimile data has been received from an exterior.

When the print process starts, the image forming apparatus 110 serves as the print control unit 210, conveys recording materials up to the position of the image forming unit 113 by the paper feeding unit 112 and the conveying unit 114 one by one, and forms an image based on various types of data such as print data on each recording material. Then, the image forming apparatus 110 sequentially conveys recording materials with the image formed on one side or both sides thereof to the downstream post-processing apparatuses 120*a* to 120*e*. Each of the post-processing apparatuses 120*a* to 120*e* performs predetermined post-processing on each recording material and discharges the recording material to any one of the discharge units 127*c* to 127*e* provided in the third to fifth post-processing apparatuses 120*c* to 120*e*.

(Step S101)

At this time, the image forming apparatus 110 serves as the abnormality detection unit 220 and determines whether conveyance abnormality of a recording material has occurred in the conveyance path in the image forming system 100. For example, when it has been detected that a paper presence signal is supplied from the sensors 116, 124*a* to 124*e*, and a recording material stops in the same position for a long time (equal to or more than a predetermined threshold value), the image forming apparatus 110 determines that the conveyance abnormality has occurred. On the other hand, when the paper presence signal indicating the stoppage of a recording material in the same position for a long time has not been supplied from the sensors 116,124*a* to 124*e* (or when a paper absence signal has been supplied), the image forming apparatus 110 determines that the conveyance abnormality has not occurred.

When it has been determined that the conveyance abnormality of the recording material has not occurred in the conveyance path in the image forming system 100 (step S101: NO), the image forming apparatus 110 waits until the conveyance abnormality of the recording material occurs while continuing the print process. On the other hand, when it has been determined that the conveyance abnormality of the recording material has occurred in the conveyance path in the image forming system 100 (step S101: YES), the image forming apparatus 110 allows the procedure to proceed to step S102.

(Step S102)

The image forming apparatus 110 serves as the notification control unit 260 and notifies a user of the occurrence of the conveyance abnormality of the recording material in the image forming system 100, an order of post-processing apparatuses to perform a task of removing the recording material, and the like. The notification is performed by displaying a message on the display (the notification unit 117) or sound output from the speaker (the notification unit 117).

For example, as with the examples illustrated in FIG. 5 and FIG. 6, when conveyance abnormality such as jam has occurred in the third post-processing apparatus 120*c*, the fourth post-processing apparatus 120*d*, and the fifth post-processing apparatus 120*e*, the image forming apparatus 110 notifies the user of the occurrence of the conveyance abnormality. In addition, the image forming apparatus 110 notifies the user to remove a recording material having caused the conveyance abnormality in an order of the third post-processing apparatus 120*c*, the fourth post-processing apparatus 120*d*, and the fifth post-processing apparatus 120*e*.

(Step S103)

When the notification of step S102 is made, the user performs the task of removing the recording material having caused the conveyance abnormality according to the notification content. For example, when the task of removing the recording material has been performed in the order notified in step S102, the conveyance abnormality such as jam is released in the order of the third post-processing apparatus 120*c*, the fourth post-processing apparatus 120*d*, and the fifth post-processing apparatus 120*e* as illustrated in (A) to (C) of FIG. 5. At this time, a paper absence signal from the sensors 124*a* to 124*e* is supplied to the image forming apparatus 110 via the communication units 126*a* to 126*e* in each of the post-processing apparatuses 120*c* to 120*e* in which the task of removing the recording material has ended (that is, the conveyance abnormality has been released). Furthermore, when the front doors of the post-processing apparatuses 120*c* to 120*e*, in which the task of removing the recording material has ended, have been closed, a closing signal indicating the closing of the front doors is supplied from the interlock units 125*c* to 125*e* to the image forming apparatus 110.

On the basis of the detection result (the paper absence signal and the closing signal) from the third to fifth post-processing apparatuses 120*c* to 120*e*, the image forming apparatus 110 determines whether the task of removing the recording material has ended in all the post-processing apparatuses 120*c* to 120*e* in which the conveyance abnormality has occurred.

For example, as illustrated in (A) of FIG. 5, when the paper absence signal and the closing signal have been supplied only from the third post-processing apparatus 120*c*, the image forming apparatus 110 determines that the task of removing the recording material has not ended in all the post-processing apparatuses 120*c* to 120*e*. Furthermore, as illustrated in (B) of FIG. 5, even when the paper absence signal and the closing signal have been supplied from the third and fourth post-processing apparatuses 120*c* and 120*d*, the image forming apparatus 110 determines that the task of removing the recording material has not ended in all the post-processing apparatuses 120*c* to 120*e*. Furthermore, as illustrated in (C) of FIG. 5, when the paper absence signal and the closing signal have been supplied from the third to fifth post-processing apparatuses 120*c* to 120*e*, the image forming apparatus 110 determines that the task of removing the recording material has ended in all the post-processing apparatuses 120*c* to 120*e*.

Furthermore, as with the example illustrated in FIG. 6, there is also a case in which the task of removing the recording material is not performed in the order notificated in step S102. For example, as illustrated in (A) to (C) of FIG. 6, there is also a case in which the conveyance abnormality such as jam is released in the order of the third post-processing apparatus 120*c*, the fifth post-processing apparatus 120*e*, and the fourth post-processing apparatus 120*d*. Also in this case, the paper absence signal from the sensors 124*a* to 124*e* and the closing signal from the interlock units 125*c* to 125*e* are supplied to the image forming apparatus 110 in each of the post-processing apparatuses 120*c* to 120*e* in which the task of removing the recording material has ended (that is, the conveyance abnormality has been released).

Then, as illustrated in (C) of FIG. 6, when the paper absence signal and the closing signal have been supplied from the third to fifth post-processing apparatuses 120*c* to 120*e*, the image forming apparatus 110 determines that the task of removing the recording material has ended in all the post-processing apparatuses 120*c* to 120*e*.

When it has been determined that the task of removing the recording material has not ended in all the post-processing apparatuses 120*c* to 120*e* (step S103: NO), the image forming apparatus 110 waits until the task of the user ends. On the other hand, when it has been determined that the task of removing the recording material has ended in all the post-processing apparatuses 120*c* to 120*e* (step S103: YES), the image forming apparatus 110 allows the procedure to proceed to step S104.

(Step S104)

The image forming apparatus 110 serves as the position detection unit 230 and detects the position of the user who performs the task of removing the recording material having caused the conveyance abnormality detected in step S101. For example, the image forming apparatus 110 detects the position of a post-processing apparatus, in which the removal task has been finally performed, as the position of the user. In detail, it is sufficient if the position of a post-processing apparatus, which has finally supplied the paper absence signal and the closing signal in step S103, as the position of the user. Consequently, in the example illustrated in FIG. 5, the position of the fifth post-processing apparatus 120*e* is detected as the position of a user who has finally performed the task of removing the recording material. In a similar manner, in the example illustrated in FIG. 6, the position of the fourth post-processing apparatus 120*d* is detected as the position of a user who has finally performed the task of removing the recording material.

(Step S105)

The image forming apparatus 110 serves as the selection unit 240 and determines whether it is possible to discharge (perform a purge process on) a recording material remaining on a conveyance path of an upstream side from a discharge unit nearest the position of the user detected in step S104. For example, on the basis of signals (the paper absence signal and the like) from the sensors 116, 124*a* to 124*e*, the image forming apparatus 110 determines whether conveyance abnormality and the like have not occurred in the conveyance path of the upstream side from the discharge unit nearest the position of the user. Moreover, the image forming apparatus 110 determines whether there is a notification indicating the completion of an initial operation from each apparatus of the upstream side from the discharge unit. Then, when the conveyance abnormality and the like have not occurred in the conveyance path of the upstream side from the discharge unit nearest the position of the user and the initial operation has been completed in each apparatus of the upstream side from the discharge unit, the image forming apparatus 110 determines that it is possible to discharge the recording material remaining on the conveyance path of the upstream side.

In addition, in the example illustrated in FIG. 5, the discharge unit nearest the position of the user is the discharge unit 127*e* provided in the fifth post-processing apparatus 120*e*, and in the example illustrated in FIG. 6, the discharge unit nearest the position of the user is the discharge unit 127*d* provided in the fourth post-processing apparatus 120*d*.

When it has been determined that it is not possible to discharge the recording material remaining on the conveyance path of the upstream side from the discharge unit nearest the position of the user (step S105: NO), the image forming apparatus 110 waits until it is possible to discharge the recording material. On the other hand, when it has been determined that it is possible to discharge the recording material remaining on the conveyance path of the upstream side from the discharge unit nearest the position of the user (step S105: YES), the image forming apparatus 110 allows the procedure to proceed to step S106.

(Step S106)

The image forming apparatus 110 serves as the selection unit 240 and selects a discharge unit which is nearest the position of the user and can discharge the recording material remaining on the conveyance path of the upstream side. That is, when the task of removing the recording material has ended in all the post-processing apparatuses, the image forming apparatus 110 selects a discharge unit, which has been determined to be able to discharge the recording material remaining on the conveyance path of the upstream side in step S105, in step S106.

In the example illustrated in FIG. 5, the discharge unit selected in step S106 is the discharge unit 127*e* provided in the fifth post-processing apparatus 120*e*, and in the example illustrated in FIG. 6, the discharge unit selected in step S106 is the discharge unit 127*d* provided in the fourth post-processing apparatus 120*d*.

(Step S107)

The image forming apparatus 110 serves as the purge processing unit 250 and performs a purge process of discharging the recording material remaining on the conveyance path of the upstream side of the discharge unit selected in step S106 to the outside of the image forming system 100.

In detail, the image forming apparatus 110 controls the conveying unit 114 and sequentially conveys all recording materials remaining on the conveyance path in the image forming apparatus 110 to the first post-processing apparatus 120*a*. At this time, the control unit 121*a* of the first post-processing apparatus 120*a* controls the conveying unit 122*a* and sequentially conveys all recording materials (including recording materials conveyed from the image forming apparatus 110) remaining in the first post-processing apparatus 120*a* to the second post-processing apparatus 120*b*. In this way, similar control is made also in the downstream post-processing apparatuses 120*b* to 120*e*, and the recording material remaining on the conveyance path of the upstream side of the discharge unit selected by the selection unit 240 is discharged to the outside of the image forming system 100 from the discharge unit.

For example, in the example illustrated in (D) of FIG. 5, the recording material is discharged from the discharge unit 127*e* provided in the fifth post-processing apparatus 120*e* by the purge process of step S107, and in the example illustrated in (D) of FIG. 6, the recording material is discharged from the discharge unit 127*d* provided in the fourth post-processing apparatus 120*d* by the purge process of step S107.

Furthermore, the image forming apparatus 110 serves as the notification control unit 260 and notifies the user of the discharge situation of the recording materials while the purge process of step S107 is being performed. Then, when the purge process of step S107 has been completed, the image forming apparatus 110 notifies the user that the discharge of the recording materials has been completed. In addition, the notification is performed by displaying a message on the display (the notification unit 117) or sound output from the speaker (the notification unit 117).

After the above-described purge process ends, the image forming apparatus 110 ends the print process. However, when uncompleted print remains, the image forming apparatus 110 may also reopen print and allow the procedure to return to step S101.

The above-described print process is performed in the image forming apparatus 110, so that the position of a user performing a task of removing a recording material having caused conveyance abnormality is detected and a discharge unit nearest the position is selected as a discharge unit of the recording material at the time of a purge process. Therefore, it is possible to prevent forgetting of a recording material to be discharged at the time of the purge process and simplify a task of going for the recording material up to a discharge unit.

Furthermore, since a task of removing recording materials ends in all post-processing apparatuses and then the recording materials are discharged, the conveyance and print of recording materials are not performed during the task of removing the recording materials, so that safety is high.

Second Embodiment

Next, a second embodiment of the present invention will be described. Hereinafter, a description for points common to the first embodiment will be appropriately omitted and different points will be mainly described.

Since the hardware configuration and the functional configuration of an image forming system 100 according to the second embodiment are similar to those of the first embodiment, a description thereof will be omitted. An operation of the image forming system 100 according to the second embodiment is different from that of the first embodiment. Therefore, hereinafter, the characteristic operation of the image forming system 100 according to the second embodiment will be described.

(2) Print Process (Second Embodiment)

Figure 7:
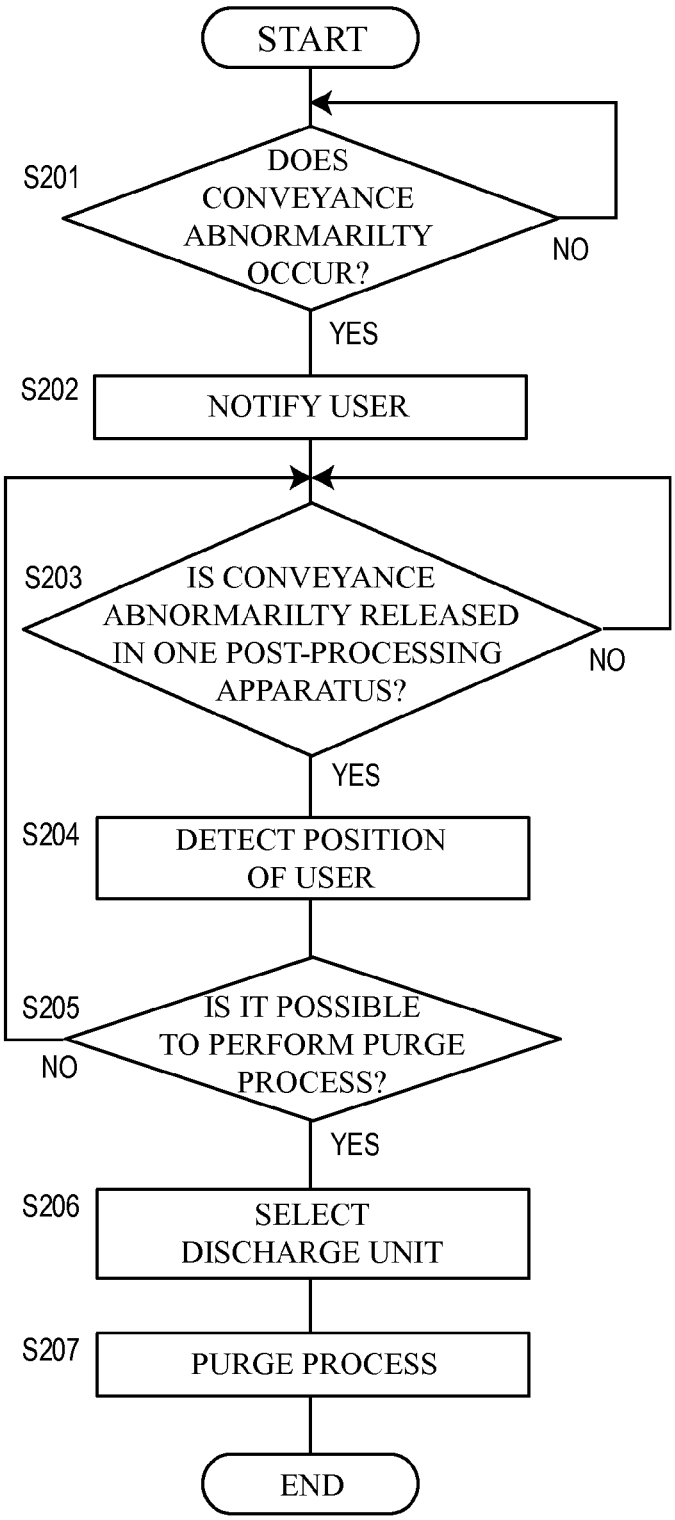
FIG. 7 is a flowchart illustrating the procedure of a print process according to a second embodiment.
Figure 8:
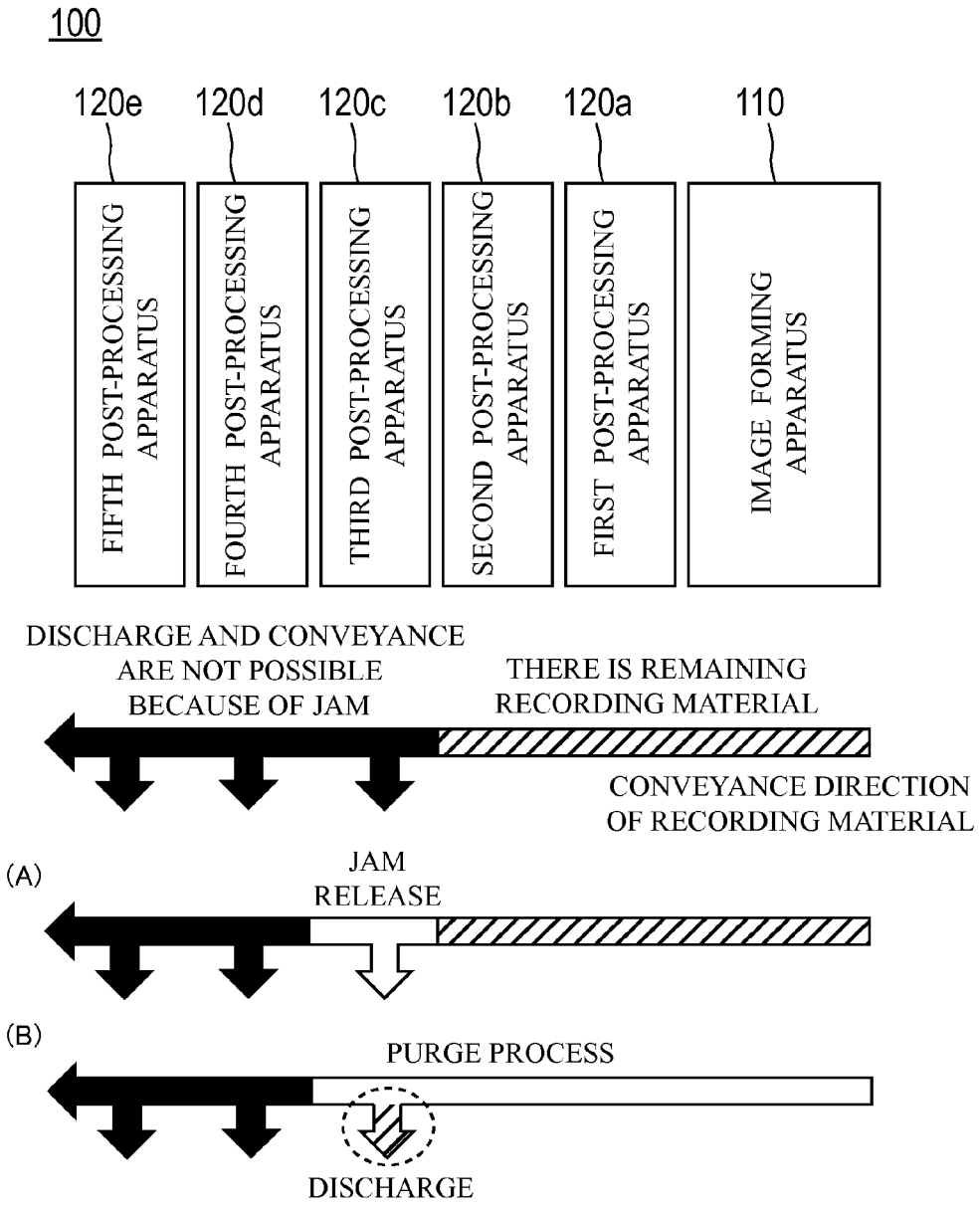
FIG. 8 is a diagram illustrating an operation example 1 until a purge process is performed after conveyance abnormality occurs in an image forming system according to a second embodiment.
Figure 9:
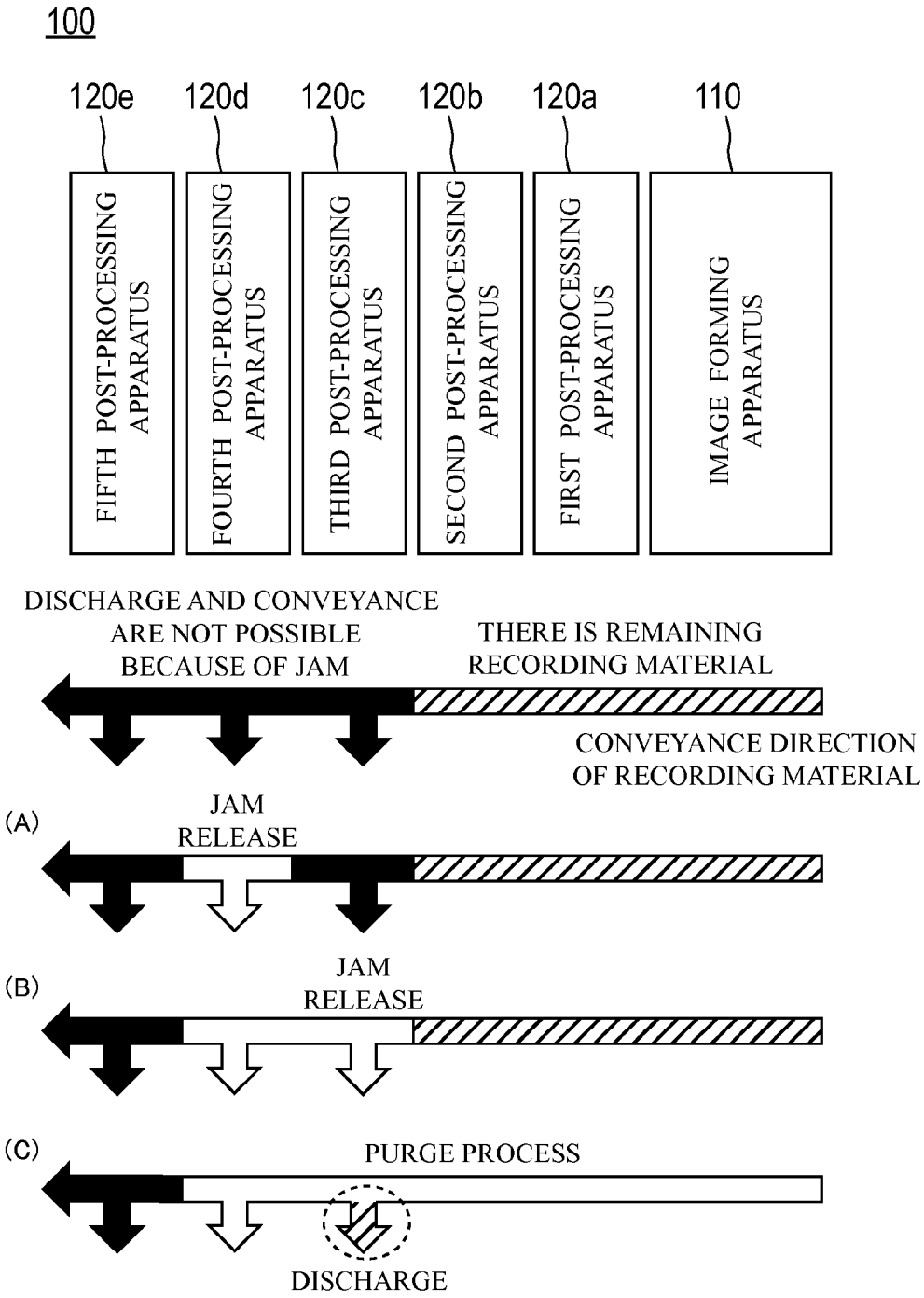
FIG. 9 is a diagram illustrating an operation example 2 until a purge process is performed after conveyance abnormality occurs in an image forming system according to a second embodiment.

FIG. 7 is a flowchart illustrating the procedure of the print process according to the second embodiment. FIG. 8 is a diagram illustrating an operation example 1 until a purge process is performed after conveyance abnormality occurs in the image forming system according to the second embodiment. FIG. 9 is a diagram illustrating an operation example 2 until the purge process is performed after the conveyance abnormality occurs in the image forming system according to the second embodiment.

Hereinafter, with reference to FIG. 7 to FIG. 9, the print process according to the second embodiment will be described.

The timing at which the print process according to the second embodiment starts is similar to that of the first embodiment.

When the print process starts, the image forming apparatus 110 forms an image on recording materials and sequentially conveys the recording materials to the downstream post-processing apparatuses 120*a* to 120*e*, similarly to the first embodiment. Each of the post-processing apparatuses 120*a* to 120*e* performs predetermined post-processing on each recording material and discharges the recording material to anyone of the discharge units 127*c* to 127*e* provided in the third to fifth post-processing apparatuses 120*c* to 120*e*.

(Step S201)

At this time, the image forming apparatus 110 serves as the abnormality detection unit 220 and determines whether conveyance abnormality of a recording material has occurred in a conveyance path in the image forming system 100, similarly to step S101 of the first embodiment.

When it has been determined that the conveyance abnormality of the recording material has not occurred in the conveyance path in the image forming system 100 (step S201: NO), the image forming apparatus 110 waits until the conveyance abnormality of the recording material occurs while continuing the print process. On the other hand, when it has been determined that the conveyance abnormality of the recording material has occurred in the conveyance path in the image forming system 100 (step S201: YES), the image forming apparatus 110 allows the procedure to proceed to step S202.

(Step S202)

The image forming apparatus 110 serves as the notification control unit 260 and notifies a user of the occurrence of the conveyance abnormality of the recording material in the image forming system 100, an order of post-processing apparatuses to perform a task of removing the recording material, and the like, similarly to step S102 of the first embodiment.

For example, as with the examples illustrated in FIG. 8 and FIG. 9, when conveyance abnormality such as jam has occurred in the third post-processing apparatus 120*c*, the fourth post-processing apparatus 120*d*, and the fifth post-processing apparatus 120*e*, the image forming apparatus 110 notifies the user of the occurrence of the conveyance abnormality. In addition, the image forming apparatus 110 notifies the user to remove a recording material having caused the conveyance abnormality in an order of the third post-processing apparatus 120*c*, the fourth post-processing apparatus 120*d*, and the fifth post-processing apparatus 120*e*.

(Step S203)

When the notification of step S202 is made, the user performs the task of removing the recording material having caused the conveyance abnormality according to the notification content.

For example, when the task of removing the recording material is performed in the order notificated in step S202, the conveyance abnormality such as jam in the third post-processing apparatus 120*c* is initially released as illustrated in (A) of FIG. 8. Furthermore, there is also a case in which the task of removing the recording material is not performed in the order notificated in step S202. For example, as illustrated in (A) of FIG. 9, there is also a case in which the conveyance abnormality such as jam is initially released in an order of the fourth post-processing apparatus 120*d*.

Also in any case, the post-processing apparatuses 120*c* and 120*d*, in which the task of removing the recording material has ended (that is, the conveyance abnormality has been released), supplies the image forming apparatus 110 with a paper absence signal from the sensors 124*c* and 124*d* via the communication units 126*c* and 126*d*. Furthermore, when the front doors of the post-processing apparatuses 120*c* and 120*d*, in which the task of removing the recording material has ended, have been closed, a closing signal indicating the closing of the front doors is supplied from the interlock units 125*c* and 125*d* to the image forming apparatus 110.

On the basis of the detection result (the paper absence signal and the closing signal) from the post-processing apparatuses 120*c* and 120*d* in which the task of removing the recording material has ended, the image forming apparatus 110 determines whether the task of removing the recording material has ended in at least one post-processing apparatus.

For example, as illustrated in (A) of FIG. 8, when the paper absence signal and the closing signal have been supplied only from the third post-processing apparatus 120*c*, the image forming apparatus 110 determines that the task of removing the recording material has ended in at least one post-processing apparatus. Furthermore, as illustrated in (A) of FIG. 9, even when the paper absence signal and the closing signal have been supplied only from the fourth post-processing apparatus 120*d*, the image forming apparatus 110 determines that the task of removing the recording material has ended in at least one post-processing apparatus.

When there is no one post-processing apparatus in which the task of removing the recording material has ended (step S203: NO), the image forming apparatus 110 waits until the task of removing the recording material ends in at least one post-processing apparatus. On the other hand, when it has been determined that the task of removing the recording material has ended in at least one of the post-processing apparatuses 120*c* to 120*e* (step S203: YES), the image forming apparatus 110 allows the procedure to proceed to step S204.

(Step S204)

The image forming apparatus 110 serves as the position detection unit 230 and detects the position of the user who performs the task of removing the recording material having caused the conveyance abnormality detected in step S201. For example, the image forming apparatus 110 detects, as the position of the user, the position of a post-processing apparatus immediately after performing the task of removing the recording material. In detail, it is sufficient if the position of a post-processing apparatus, which has supplied the paper absence signal and the closing signal in the immediately previous step S203, as the position of the user. Consequently, in the stage of (A) of FIG. 8, the position of the third post-processing apparatus 120*c* is detected as the position of the user, and in the stage of (A) of FIG. 9, the position of the fourth post-processing apparatus 120*d* is detected as the position of the user.

(Step S205)

The image forming apparatus 110 serves as the selection unit 240 and determines whether it is possible to discharge (perform a purge process on) a recording material remaining on a conveyance path of an upstream side from a discharge unit nearest the position of the user detected in step S204. A determination method in step S205 is similar to that of step S105 of the first embodiment.

In addition, in the stage of (A) of FIG. 8, the discharge unit nearest the position of the user is the discharge unit 127*c* provided in the third post-processing apparatus 120*c*, and in the stage of (A) of FIG. 9, the discharge unit nearest the position of the user is the discharge unit 127*d* provided in the fourth post-processing apparatus 120*d*.

When it has been determined that it is not possible to discharge the recording material remaining on the conveyance path of the upstream side from the discharge unit nearest the position of the user at the present time (step S205: NO), the image forming apparatus 110 allows the procedure to return to step S203 and waits until the task of removing the recording material is newly performed in another post-processing apparatus. On the other hand, when it has been determined that it is possible to discharge the recording material remaining on the conveyance path of the upstream side from the discharge unit nearest the position of the user at the present time (step S205: YES), the image forming apparatus 110 allows the procedure to proceed to step S206.

In addition, in the example illustrated in (A) of FIG. 8, since it is possible to discharge the recording material remaining on the conveyance path of the upstream side from the discharge unit 127*c* (the third post-processing apparatus 120*c*) nearest the position of the user, the procedure proceeds to step S206. On the other hand, in the example illustrated in (A) of FIG. 9, since it is not possible to discharge the recording material remaining on the conveyance path of the upstream side from the discharge unit 127*d* (the fourth post-processing apparatus 120*d*) nearest the position of the user, the procedure returns to step S203. In this case, the user newly performs the task of removing the recording material having caused the conveyance abnormality from another post-processing apparatus (the third post-processing apparatus 120*c* in the example illustrated in (B) of FIG. 9). Hereinafter, the processes of the above-described steps S203 to S205 are performed. As illustrated in (B) of FIG. 9, if it is possible to discharge the recording material remaining on the conveyance path of the upstream side from the discharge unit 127*c* (the third post-processing apparatus 120*c*) nearest the position of the user, the procedure proceeds to step S206.

(Step S206)

The image forming apparatus 110 serves as the selection unit 240 and selects a discharge unit which is nearest the position of the user at the present time and can discharge the recording material remaining on the conveyance path of the upstream side. That is, when the task of removing the recording material has ended in at least one post-processing apparatus, the image forming apparatus 110 selects a discharge unit, which has been determined to be able to discharge the recording material remaining on the conveyance path of the upstream side in step S205, in step S206.

In the examples illustrated in (B) of FIG. 8 and (C) of FIG. 9, in any one, the discharge unit selected in step S206 is the discharge unit 127*c* provided in the third post-processing apparatus 120*c*.

(Step S207)

The image forming apparatus 110 serves as the purge processing unit 250 and performs a purge process of discharging the recording material remaining on the conveyance path of the upstream side of the discharge unit selected in step S206 to the outside of the image forming system 100, similarly to step S107 of the first embodiment.

Furthermore, the image forming apparatus 110 serves as the notification control unit 260 and notifies the user of the discharge situation of the recording materials while the purge process of step S207 is being performed. Then, when the purge process of step S207 has been completed, the image forming apparatus 110 notifies the user that the discharge of the recording materials has been completed. In addition, the notification is performed by displaying a message on the display (the notification unit 117) or sound output from the speaker (the notification unit 117).

Furthermore, the image forming apparatus 110 serves as the notification control unit 260 and even after the purge process of step S207 is started, when there is a post-processing apparatus in which a recording material has not been removed, the image forming apparatus 110 may also notify the user of a procedure of a task of removing the recording material. For example, the fourth and fifth post-processing apparatuses 120*d* and 120*e* illustrated in (B) of FIG. 8, the fifth post-processing apparatus 120*e* illustrated in (C) of FIG. 9, and the like are notification objects.

After the above-described purge process ends, the image forming apparatus 110 ends the print process. However, when uncompleted print remains, the image forming apparatus 110 may also reopen print and allow the procedure to return to step S201.

The above-described print process is performed in the image forming apparatus 110, so that the position of a user performing a task of removing a recording material having caused conveyance abnormality is detected and a discharge unit nearest the position is selected as a discharge unit of the recording material at the time of a purge process. Therefore, it is possible to prevent forgetting of a recording material to be discharged at the time of the purge process and simplify a task of going for the recording material up to a discharge unit.

Furthermore, whenever a task of removing a recording material ends in each post-processing apparatus, since it is determined whether it is possible to discharge a recording material from a discharge unit nearest from the position of a user, there is a case in which it is possible to start the purge process without waiting until the task of removing the recording material is performed in all post-processing apparatuses, resulting in the improvement in efficiency.

Third Embodiment

Next, a third embodiment of the present invention will be described. Hereinafter, a description for points common to the first embodiment will be appropriately omitted and different points will be mainly described.

Since the hardware configuration and the functional configuration of an image forming system 100 according to the third embodiment are similar to those of the first embodiment, a description thereof will be omitted. An operation of the image forming system 100 according to the third embodiment is different from that of the first embodiment. Therefore, hereinafter, the characteristic operation of the image forming system 100 according to the third embodiment will be described.

(3) Print Process (Third Embodiment)

Figure 10:
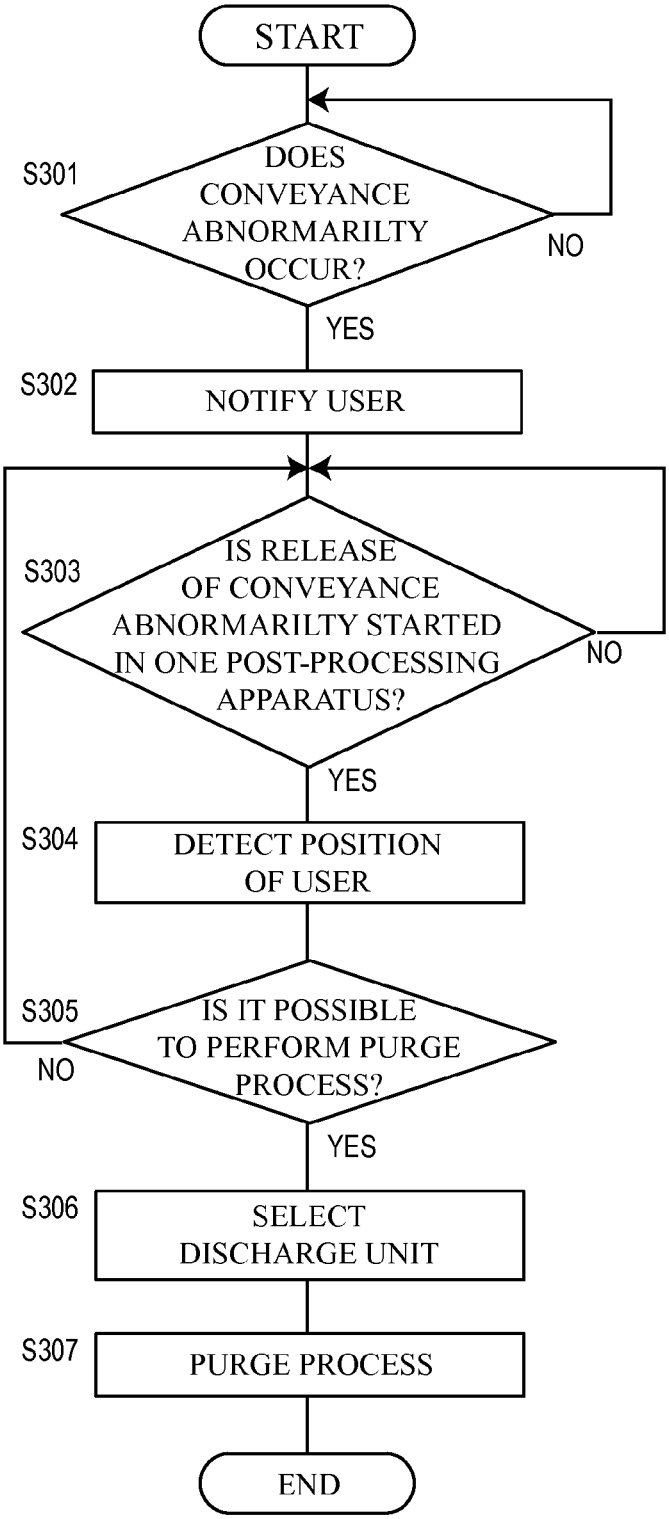
FIG. 10 is a flowchart illustrating the procedure of a print process according to a third embodiment.
Figure 11:
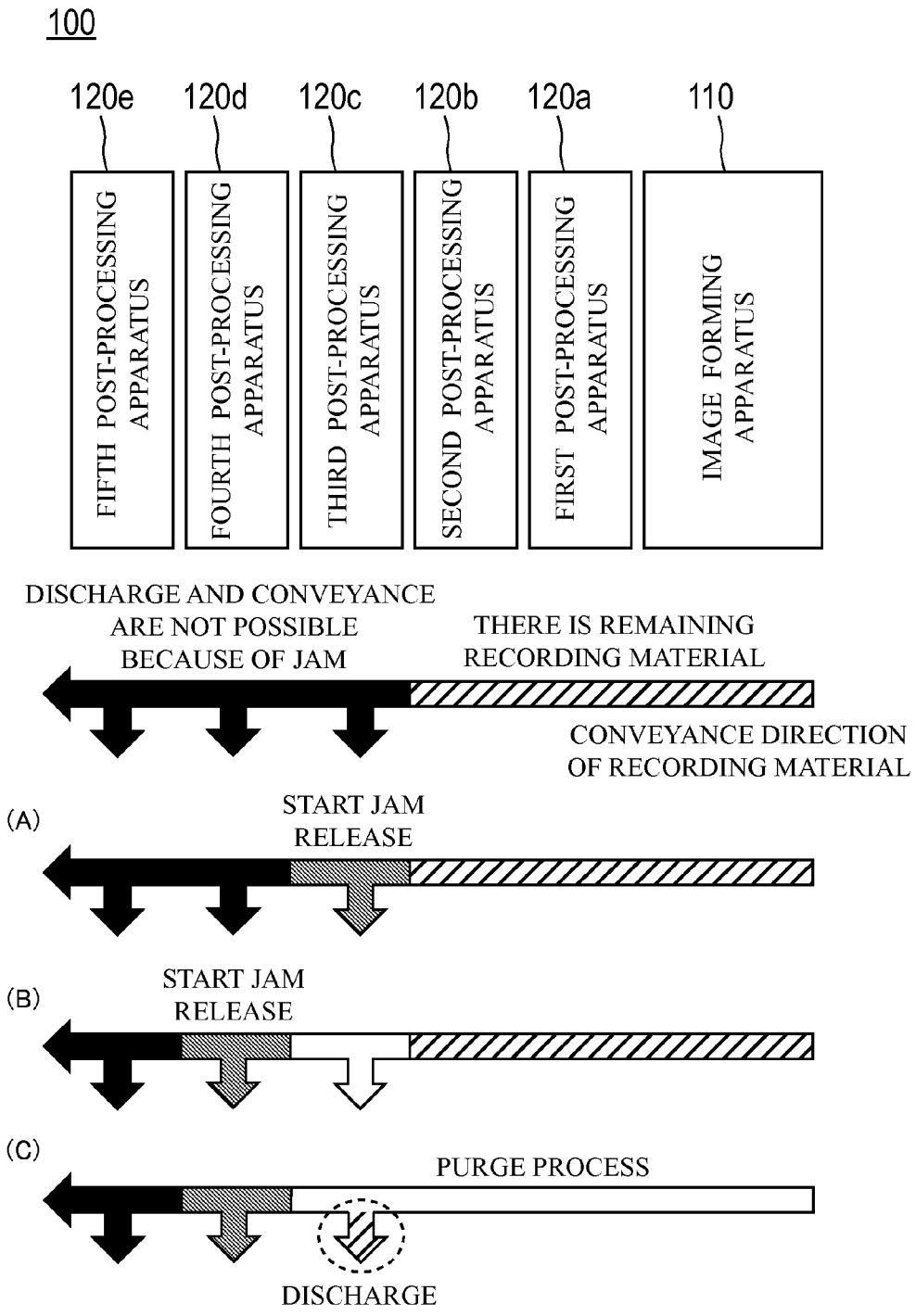
FIG. 11 is a diagram illustrating an operation example until a purge process is performed after conveyance abnormality occurs in an image forming system according to a third embodiment.

FIG. 10 is a flowchart illustrating the procedure of the print process according to the third embodiment. FIG. 11 is a diagram illustrating an operation example until a purge process is performed after conveyance abnormality occurs in the image forming system according to the third embodiment.

Hereinafter, with reference to FIG. 10 and FIG. 11, the print process according to the third embodiment will be described.

The timing at which the print process according to the third embodiment starts is similar to that of the first embodiment.

When the print process starts, the image forming apparatus 110 forms an image on recording materials and sequentially conveys the recording materials to the downstream post-processing apparatuses 120*a* to 120*e*, similarly to the first embodiment. Each of the post-processing apparatuses 120*a* to 120*e* performs predetermined post-processing on each recording material and discharges the recording material to anyone of the discharge units 127*c* to 127*e* provided in the third to fifth post-processing apparatuses 120*c* to 120*e*.

(Step S301)

At this time, the image forming apparatus 110 serves as the abnormality detection unit 220 and determines whether conveyance abnormality of a recording material has occurred in a conveyance path in the image forming system 100, similarly to step S101 of the first embodiment.

When it has been determined that the conveyance abnormality of the recording material has not occurred in the conveyance path in the image forming system 100 (step S301: NO), the image forming apparatus 110 waits until the conveyance abnormality of the recording material occurs while continuing the print process. On the other hand, when it has been determined that the conveyance abnormality of the recording material has occurred in the conveyance path in the image forming system 100 (step S301: YES), the image forming apparatus 110 allows the procedure to proceed to step S302.

(Step S302)

The image forming apparatus 110 serves as the notification control unit 260 and notifies a user of the occurrence of the conveyance abnormality of the recording material in the image forming system 100, an order of post-processing apparatuses to perform a task of removing the recording material, and the like, similarly to step S102 of the first embodiment.

For example, as with the example illustrated in FIG. 11, when conveyance abnormality such as jam has occurred in the third post-processing apparatus 120*c*, the fourth post-processing apparatus 120*d*, and the fifth post-processing apparatus 120*e*, the image forming apparatus 110 notifies the occurrence of the conveyance abnormality. In addition, the image forming apparatus 110 notifies the occurrence so as to remove a recording material having caused the conveyance abnormality in an order of the third post-processing apparatus 120*c*, the fourth post-processing apparatus 120*d*, and the fifth post-processing apparatus 120*e*.

(Step S303)

When the notification of step S302 is made, the user performs the task of removing the recording material having caused the conveyance abnormality according to the notification content.

For example, when the task of removing the recording material is performed in the order notificated in step S302, the task (release of the conveyance abnormality such as jam) of removing the recording material is initially started in the third post-processing apparatus 120*c* as illustrated in (A) of FIG. 11.

When a front door has been opened, the post-processing apparatus, in which the task of removing the recording material has been started, supplies the image forming apparatus 110 with an opening signal indicating that the front door has been opened from an interlock unit.

On the basis of the detection result (the opening signal) from the post-processing apparatus in which the task of removing the recording material has been started, the image forming apparatus 110 determines whether the task of removing the recording material has been started in at least one post-processing apparatus.

For example, as illustrated in (A) of FIG. 11, when the opening signal have been supplied from the third post-processing apparatus 120*c*, the image forming apparatus 110 determines that the task of removing the recording material has been started in at least one post-processing apparatus.

When there is no one post-processing apparatus in which the task of removing the recording material has been started (step S303: NO), the image forming apparatus 110 waits until the task of removing the recording material is started in at least one post-processing apparatus. On the other hand, when it has been determined that the task of removing the recording material has been started in at least one of the post-processing apparatuses 120*c* to 120*e* (step S303: YES), the image forming apparatus 110 allows the procedure to proceed to step S304.

(Step S304)

The image forming apparatus 110 serves as the position detection unit 230 and detects the position of the user who performs the task of removing the recording material having caused the conveyance abnormality detected in step S301. For example, the image forming apparatus 110 detects, as the position of the user, the position of a post-processing apparatus immediately after performing the task of removing the recording material. In detail, it is sufficient if the position of a post-processing apparatus, which has supplied the opening signal in the immediately previous step S303, as the position of the user. Consequently, in the stage of (A) of FIG. 11, the position of the third post-processing apparatus 120*c* is detected as the position of the user.

(Step S305)

The image forming apparatus 110 serves as the selection unit 240 and determines whether it is possible to discharge (perform a purge process on) a recording material remaining on a conveyance path of an upstream side from a discharge unit nearest the position of the user detected in the immediately previous step S304. Since it is not possible to discharge a recording material from a discharge unit of a post-processing apparatus having just started a task of removing the recording material, a discharge unit nearest the position of the user is a discharge unit provided in a post-processing apparatus positioned at an upstream side of the post-processing apparatus having started the task of removing the recording material.

When it has been determined that it is not possible to discharge the recording material remaining on the conveyance path of the upstream side from the discharge unit nearest the position of the user at the present time (step S305: NO), the image forming apparatus 110 allows the procedure to return to step S303 and waits until the task of removing the recording material is newly performed in another post-processing apparatus. On the other hand, when it has been determined that it is possible to discharge the recording material remaining on the conveyance path of the upstream side from the discharge unit nearest the position of the present user (step S305: YES), the image forming apparatus 110 allows the procedure to proceed to step S306.

In addition, in the stage illustrated in (A) of FIG. 11, since no discharge units are provided in the post-processing apparatuses 120*a* and 120*b* positioned at an upstream side of the third post-processing apparatus 120*c* having just started the task of removing the recording material, it is determined that it is not possible to discharge the recording material remaining on the conveyance path. In this case, the procedure to returns to step S303, and the user newly performs the task of removing the recording material having caused the conveyance abnormality from another post-processing apparatus (the fourth post-processing apparatus 120*d* in the example illustrated in (B) of FIG. 11). Thereafter, if it is possible to discharge the recording material remaining on the conveyance path of the upstream side from the discharge unit 127*c* (the third post-processing apparatus 120*c*) nearest the position of the user via steps S304 and S305 as illustrated in (B) of FIG. 11, the procedure proceeds to step S306.

(Step S306)

The image forming apparatus 110 serves as the selection unit 240 and selects a discharge unit which is nearest the position of the user at the present time and can discharge the recording material remaining on the conveyance path of the upstream side. That is, when the task of removing the recording material has been started in at least one post-processing apparatus, the image forming apparatus 110 selects a discharge unit, which has been determined to be able to discharge the recording material remaining on the conveyance path of the upstream side in step S305, in step S306.

In the example illustrated in (B) of FIG. 11, the discharge unit selected in step S306 is the discharge unit 127*c* provided in the third post-processing apparatus 120*c* approximate to an upstream side of the fourth post-processing apparatus 120*d* nearest the position of the user.

(Step S307)

The image forming apparatus 110 serves as the purge processing unit 250 and performs a purge process of discharging the recording material remaining on the conveyance path of the upstream side of the discharge unit selected in step S306 to the outside of the image forming system 100, similarly to step S107 of the first embodiment.

Furthermore, the image forming apparatus 110 serves as the notification control unit 260 and notifies the user of the discharge situation of the recording materials while the purge process of step S307 is being performed. Then, when the purge process of step S307 has been completed, the image forming apparatus 110 notifies the user that the discharge of the recording materials has been completed. In addition, the notification is performed by displaying a message on the display (the notification unit 117) or sound output from the speaker (the notification unit 117).

Furthermore, the image forming apparatus 110 serves as the notification control unit 260 and even after the purge process of step S307 is started, when there is a post-processing apparatus in which a recording material has not been removed, the image forming apparatus 110 may also notify the user of a procedure of a task of removing the recording material. For example, the fourth and fifth post-processing apparatuses 120*d* and 120*e* illustrated in (C) of FIG. 11 and the like are notification objects.

After the above-described purge process ends, the image forming apparatus 110 ends the print process. However, when uncompleted print remains, the image forming apparatus 110 may also reopen print and allow the procedure to return to step S301.

The above-described print process is performed in the image forming apparatus 110, so that the position of a user performing a task of removing a recording material having caused conveyance abnormality is detected and a discharge unit nearest the position is selected as a discharge unit of the recording material at the time of a purge process. Therefore, it is possible to prevent forgetting of a recording material to be discharged at the time of the purge process and simplify a task of going for the recording material up to a discharge unit.

Furthermore, whenever a task of removing a recording material is started in each post-processing apparatus, since it is determined whether it is possible to discharge a recording material from a discharge unit nearest from the position of a user, there is also a case in which it is possible to start the purge process immediately after the task of removing the recording material is performed, resulting in the improvement in efficiency.

Each processing unit of the above-described each flowchart has been divided in response to main processing content in order to facilitate the understanding of the image forming system 100. By a classification method of processing steps and names thereof, the present invention is not limited. Processes performed in the image forming system 100 can be divided into many more processing steps. Furthermore, one processing step may also perform many more processes.

<Modification>

In addition, the above-described each embodiment intends to exemplify the scope of the present invention and does not limit the present invention. Many alternatives, corrections, and modifications are apparent by those skilled in the art.

(1) Modification 1

For example, in the above-described each embodiment, an example in which five post-processing apparatuses (the post-processing apparatuses 120*a* to 120*e*) are connected to the downstream side of the image forming apparatus 110 has been described. However, the present invention is not limited thereto. For example, one to four post-processing apparatuses or six or more post-processing apparatuses may also be connected to the downstream side of the image forming apparatus 110.

However, when only one post-processing apparatus is connected to the downstream side of the image forming apparatus 110, the first post-processing apparatus 120*a* needs to have a plurality of discharge units. In this case, the print process (FIG. 4) according to the above-described first embodiment is performed, so that recording materials are removed in all the discharge units (also including a conveyance path) provided in the first post-processing apparatus 120*a* and then it is possible to discharge (perform automatic purge on) recording materials remaining on the conveyance path in the image forming apparatus 110.

Furthermore, in a stage in which it is possible to discharge recording materials from at least one of a plurality of discharge units provided in the first post-processing apparatus 120*a*, it may also be possible to discharge (perform automatic purge on) recording materials remaining on the conveyance path in the image forming apparatus 110.

Figure 12:
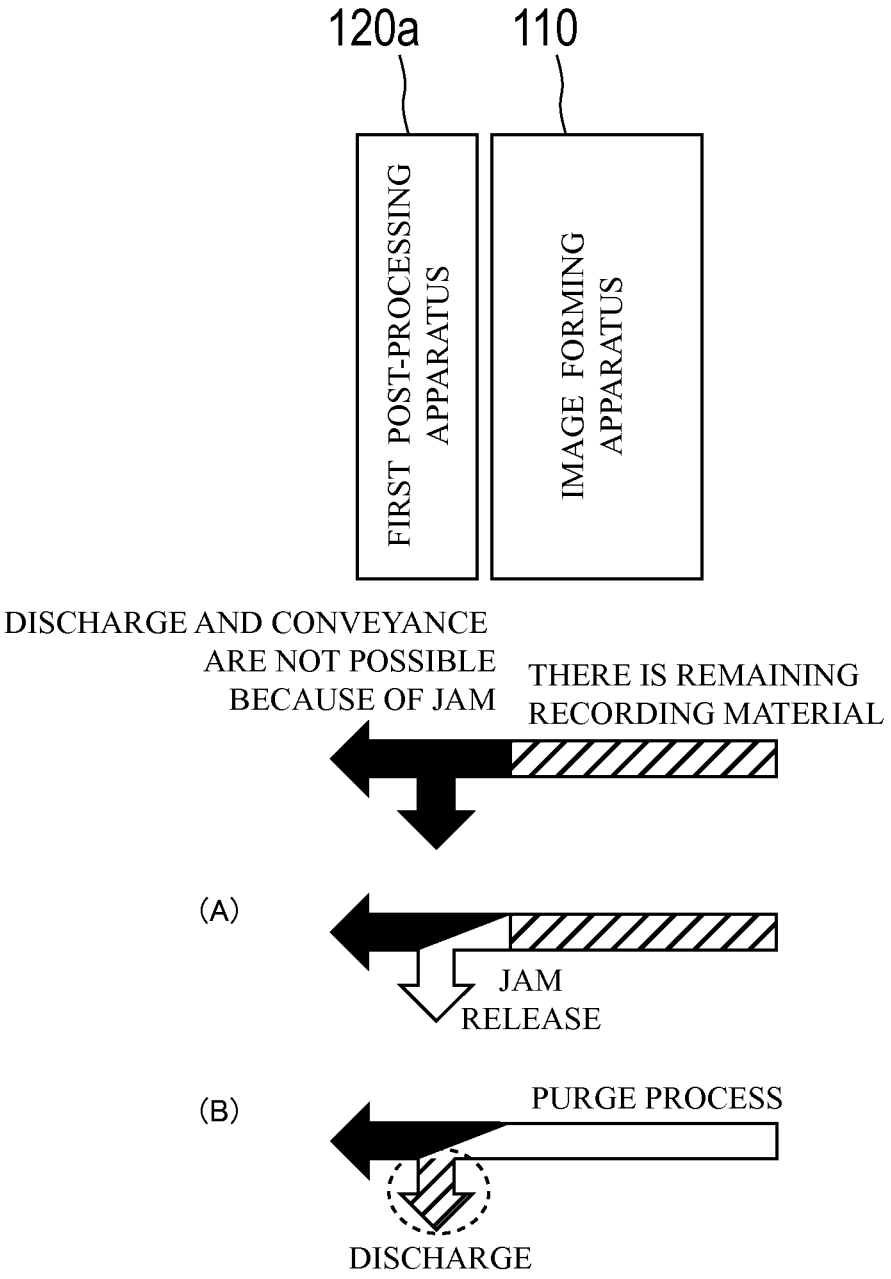
FIG. 12 is a diagram illustrating an operation example until a purge process is performed after conveyance abnormality occurs in an image forming system in which one post-processing apparatus has been connected to a downstream side of an image forming apparatus.

FIG. 12 is a diagram illustrating an operation example until a purge process is performed after conveyance abnormality occurs in an image forming system in which one post-processing apparatus has been connected to a downstream side of an image forming apparatus.

For example, the case in which conveyance abnormality has occurred in the first post-processing apparatus 120*a* of the image forming system 100 of the modification is considered. The first post-processing apparatus 120*a* has two discharge units, wherein one of them is used as a discharge unit for discharging recording materials conveyed from the image forming apparatus 110 and the other one is used as a discharge unit for discharging recording materials subjected to post-processing in the first post-processing apparatus 120*a*.

When a task of removing the recording materials has ended in one discharge unit (including a conveyance path necessary for discharging recording materials to the discharge unit), the first post-processing apparatus 120*a* supplies a paper absence signal from the sensor 124*a* to the image forming apparatus 110 via the communication unit 126. When the paper absence signal is supplied from the first post-processing apparatus 120*a*, the image forming apparatus 110 regards that it is possible to discharge recording materials remaining on the conveyance path in the image forming apparatus 110 from the one discharge unit ((A) of FIG. 12). Even though a task of removing recording materials has not been ended in the other discharge unit, the image forming apparatus 110 discharges the recording materials remaining on the conveyance path in the image forming apparatus 110 from the one discharge unit from which recording materials have been removed ((B) of FIG. 12).

By the above-described operation, the image forming system 100 of the modification can perform automatic purge on recording materials from a discharge unit nearest the position of a user in a stage in which it is possible to discharge recording materials from at least one of a plurality of discharge units provided in the first post-processing apparatus 120*a*.

(2) Modification 2

Furthermore, in the above-described each embodiment, the position detection unit 230 detects the position of a post-processing apparatus having supplied the paper absence signal and the closing signal as the position of a user who performs a task of removing recording materials. However, the present invention is not limited thereto, and by using short range radio communication (a radio tag) and the like, a post-processing apparatus nearest a user may also be specified and the position of the post-processing apparatus may also be detected as the position of the user who performs the task of removing the recording materials.

(3) Modification 3

Furthermore, in the above-described each embodiment, no discharge units are provided in the first and second post-processing apparatuses 120*a* and 120*b* and discharge units are respectively provided in the third to fifth post-processing apparatuses 120*c* to 120*e*. However, the present invention is not limited thereto, and if the number of discharge units is plural, the discharge unit may also be provided in any post-processing apparatus.

(4) Modification 4

Furthermore, in the above-described each embodiment, the functional units 210, 220, 230, 240, 250, and 260 illustrated in FIG. 3 are provided in the control unit 111 of the image forming apparatus 110. However, the present invention is not limited thereto, and processes according to a partial functional unit may also be performed in the post-processing apparatuses 120*a* to 120*e*.

The configurations of the above-described image forming system 100 are for explaining main configurations when explaining the characteristics of the above-described each embodiment and modification, and are not limited to the above-described configurations. Furthermore, configurations provided in a general image forming system 100 are not excluded.

Furthermore, each functional configuration of the above-described image forming system 100 has been divided in response to main processing content in order to facilitate the understanding of each functional configuration. By a classification method of elements and names thereof, the present invention is not limited. Each functional configuration can be classified into many more elements according to processing content. Furthermore, one element can be classified so as to perform many more processes.

Furthermore, processes of each functional configuration of the above-described image forming system 100 can also be implemented by dedicated hardware circuits. In this case, the processes may also be implemented by one hardware or a plurality of types of hardware.

Furthermore, programs for operating the image forming system 100 may also be provided by a computer-readable recording medium such as a USB memory, a flexible disk, and a CD-ROM or may also be provided on-line via a network such as the Internet. In this case, the programs recorded on the computer-readable recording medium are generally transmitted to and stored in a memory, a storage and the like. Furthermore, the programs, for example, may also be provided as dedicated application software or may also be incorporated in software of each apparatus of the image forming system 100 as one function of the image forming system 100.

What is claimed is:

1. An image forming system including an image forming apparatus that forms an image on a recording material and one or more post-processing apparatuses that perform post-processing on the recording material with the formed image, comprising:

a plurality of discharge units provided in the image forming system in order to discharge a recording material;

an abnormality detection unit which detects conveyance abnormality of a recording material in a conveyance path in the image forming system;

a position detection unit which detects a position of a user who performs a task of removing the recording material having caused the conveyance abnormality detected by the abnormality detection unit;

a selection unit which selects a discharge unit, which is able to discharge a recording material remaining on a conveyance path of an upstream side and is nearest to the position of the user detected by the position detection unit, from the plurality of discharge units; and a purge processing unit which allows the recording material remaining on the conveyance path of the upstream side from the discharge unit selected by the selection unit to be discharged from the discharge unit.

2. The image forming system as claimed in claim 1, wherein in a case in which a plurality of post-processing apparatuses are provided, after conveyance abnormality of a recording material is detected in two or more post-processing apparatuses by the abnormality detection unit, when a task of removing the recording material has ended in all the post-processing apparatuses, if a discharge unit provided in a post-processing apparatus in which the removal task has been finally performed is able to discharge the recording material remaining on the conveyance path, the selection unit selects the discharge unit.

3. The image forming system as claimed in claim 1, wherein in a case in which a plurality of post-processing apparatuses are provided, after conveyance abnormality of a recording material is detected in two or more post-processing apparatuses by the abnormality detection unit, when a task of removing the recording materials has ended in at least one post-processing apparatus, if a discharge unit provided in the post-processing apparatus is able to discharge the recording material remaining on the conveyance path, the selection unit selects the discharge unit.

4. The image forming system as claimed in claim 1, wherein in a case in which a plurality of post-processing apparatuses are provided, after conveyance abnormality of a recording material is detected in two or more post-processing apparatuses by the abnormality detection unit, when a task of removing the recording materials has been started in at least one post-processing apparatus, if a discharge unit provided in a post-processing apparatus approximate to an upstream side of the post-processing apparatus is able to discharge the recording material remaining on the conveyance path, the selection unit selects the discharge unit.

5. The image forming system as claimed in claim 2, further comprising:

an order notification unit which notifies a user of an order of post-processing apparatuses to perform the task of removing the recording materials in a case in which the conveyance abnormality of the recording material has been detected in two or more post-processing apparatuses by the abnormality detection unit.

6. The image forming system as claimed in claim 1, further comprising:

a procedure notification unit which notifies a user of a procedure of a task of removing a recording material when there is a post-processing apparatus in which a recording material has not been removed even after discharge of a recording material by the purge processing unit is started.

7. The image forming system as claimed in claim 1, further comprising:

a situation notification unit which notifies a user of a discharge situation of a recording material while discharge of the recording material by the purge processing unit is being performed, and, when the discharge of the recording material by the purge processing unit has been completed, notifies the user that the discharge of the recording material has been completed.

8. A discharge method of a recording material in an image forming system including an image forming apparatus that forms an image on the recording material and one or more post-processing apparatuses that perform post-processing on the recording material with the formed image, wherein the image forming system has a plurality of discharge units in order to discharge a recording material, and wherein the discharge method comprises:

(a) detecting conveyance abnormality of a recording material in a conveyance path in the image forming system;

(b) detecting a position of a user who performs a task of removing the recording material having caused the conveyance abnormality detected in the (a) detecting;

(c) selecting a discharge unit, which is able to discharge a recording material remaining on a conveyance path of an upstream side and is nearest to the position of the user detected in the (b) detecting, from the plurality of discharge units; and (d) allowing the recording material remaining on the conveyance path of the upstream side from the discharge unit selected in the (c) selecting to be discharged from the discharge unit.

* * * * *